US009995463B2

(12) United States Patent
Kjeldsen et al.

(10) Patent No.: US 9,995,463 B2
(45) Date of Patent: Jun. 12, 2018

(54) ILLUMINATION DEVICE WITH SPINNING ZOOM LENS

(71) Applicant: Martin Professional APS, Aarhus (DK)

(72) Inventors: Jesper Kjeldsen, Silkeborg (DK); Nina Kildeby, Gedved (DK); Peter Skytte Christoffersen, Brabrand (DK); Carsten Dalsgaard, Silkeborg (DK); Aleksander Henrik Von Preyss, Lystrup (DK)

(73) Assignee: MARTIN PROFESSIONAL APS, Aarhus N. (DK)

( * ) Notice: Subject to any disclaimer, the term of this patent is extended or adjusted under 35 U.S.C. 154(b) by 94 days.

(21) Appl. No.: 15/025,258

(22) PCT Filed: Sep. 25, 2014

(86) PCT No.: PCT/DK2014/050301

§ 371 (c)(1),
(2) Date: Mar. 25, 2016

(87) PCT Pub. No.: WO2015/048971

PCT Pub. Date: Apr. 9, 2015

(65) Prior Publication Data

US 2016/0215961 A1 Jul. 28, 2016

(30) Foreign Application Priority Data

| | | |
|---|---|---|
| Oct. 5, 2013 | (DK) | 2013 00566 |
| Nov. 13, 2013 | (DK) | 2013 70677 |
| Nov. 13, 2013 | (DK) | 2013 70679 |

(51) Int. Cl.
*F21V 14/06* (2006.01)
*F21V 5/00* (2018.01)
(Continued)

(52) U.S. Cl.
CPC ..... *F21V 14/06* (2013.01); *F21V 5/007* (2013.01); *F21V 13/02* (2013.01); *F21V 29/67* (2015.01);
(Continued)

(58) Field of Classification Search
CPC ..... F21S 10/007; F21S 10/026; F21S 10/06; F21S 10/065; F21V 13/02; F21V 5/007; F21V 14/06; F21W 2131/406
See application file for complete search history.

(56) References Cited

U.S. PATENT DOCUMENTS

2006/0126336 A1* 6/2006 Solomon ..... F21S 10/007 362/277
2009/0219717 A1 9/2009 Feinbloom et al.
(Continued)

FOREIGN PATENT DOCUMENTS

CN 102937258 A 2/2013
EP 2428720 A2 3/2012
(Continued)

OTHER PUBLICATIONS

International Search Report for Application No. PCT/DK2014/050301, dated Dec. 16, 2014.
(Continued)

*Primary Examiner* — Anh Mai
*Assistant Examiner* — Steven Horikoshi
(74) *Attorney, Agent, or Firm* — Artegis Law Group, LLP

(57) ABSTRACT

The present invention relates to an illumination device comprising a number of light sources arranged in at least a first group of light sources and in a second group of light sources, where said first group of light sources and said second group of light sources are individually controllable. Optical means collect light from the first and second group of light sources and convert the collected light into a number of first and second light beams. The illumination device comprises further zoom adapted to change the beam diverges and/or width of respectively the first and second light beams and rotating means adapted to change the refraction of the light source beam in relation to a primary optical axis.

16 Claims, 14 Drawing Sheets

(51) Int. Cl.

| | |
|---|---|
| ***F21V 13/02*** | (2006.01) |
| *F21W 131/406* | (2006.01) |
| *F21V 29/67* | (2015.01) |
| *F21Y 115/10* | (2016.01) |
| *F21Y 113/13* | (2016.01) |
| *F21Y 105/18* | (2016.01) |

(52) U.S. Cl.
CPC .... *F21W 2131/406* (2013.01); *F21Y 2105/18* (2016.08); *F21Y 2113/13* (2016.08); *F21Y 2115/10* (2016.08)

(56) References Cited

U.S. PATENT DOCUMENTS

| | | | | |
|---|---|---|---|---|
| 2011/0103073 | A1 | 5/2011 | Jurik | |
| 2012/0091917 | A1* | 4/2012 | Vinther ..... | F21S 10/023 315/312 |
| 2012/0121244 | A1 | 5/2012 | Stavely | |

FOREIGN PATENT DOCUMENTS

| | | | |
|---|---|---|---|
| WO | 2006/113745 | A2 | 10/2006 |
| WO | 2007/007271 | A2 | 1/2007 |
| WO | 2007/049176 | A1 | 5/2007 |
| WO | 2010084187 | A1 | 1/2010 |
| WO | 2011/131197 | A1 | 10/2011 |
| WO | 2011/131199 | A1 | 10/2011 |
| WO | 2011/131200 | A1 | 10/2011 |
| WO | 2012/083957 | A1 | 6/2012 |
| WO | 2012/167800 | A1 | 12/2012 |
| WO | 2013/029630 | A1 | 3/2013 |
| WO | 2013060329 | A1 | 5/2013 |
| WO | 2013/139338 | A1 | 9/2013 |

OTHER PUBLICATIONS

Extended European Search Report for Application No. EP 14851330.2 dated Apr. 24, 2017, 5 pages.

* cited by examiner 401
406
404
402
A
A
205
203

210
401
415
406
413
402
217
218
203
205

401
406
404
402
A
A
205
203

415
406
413
401
404
210
205
203
217
218
402
207

ILLUMINATION DEVICE WITH SPINNING ZOOM LENS

CROSS-REFERENCE TO RELATED APPLICATIONS

The present application is a national stage application of the international application titled, "ILLUMINATION DEVICE WITH SPINNING ZOOM LENS," filed on Sep. 25, 2014 and having application number PCT/DK2014/050301. This international application claims priority to the Danish patent application filed on Oct. 5, 2013 and having application number PA 2013 00566, the Danish patent application filed on Nov. 13, 2013 and having application number PA 2013 70677, and the Danish patent application filed on Nov. 13, 2013 and having application number PA 2013 70679. The subject matter of these related applications is hereby incorporated herein by reference.

FIELD OF THE INVENTION

The present invention relates to an illumination device comprising a number of light sources and a number of optical means arranged in a housing. The number of optical means are adapted to collect light from at least one of the light sources and to convert the collected light into a number of light beams and the light beams are emitted from the housing.

BACKGROUND OF THE INVENTION

In order to create various light effects and mood lighting in connection with concerts, live shows, TV shows, sport events or as a part on architectural installation, light fixtures creating various effects are getting more and more used in the entertainment industry. Typically entertainment light fixtures create a light beam having a beam width and a divergence and can for instance be wash/flood fixtures creating a relatively wide light beam with a uniform light distribution or it can be profile fixtures adapted to project image onto a target surface.

Light emitting diodes (LED) are, due to their relatively low energy consumption or high efficiency, long lifetime, and capability of electronic dimming, becoming more and more used in connection with lighting applications. LEDs are used in lighting applications for general illumination such as wash/flood lights illuminating a wide area or for generating wide light beams e.g. for the entertainment industry and/or architectural installations. For instance like in products like MAC101™, MAC301™, MAC401™, MAC Aura™, Stagebar2™, Easypix™, Extube™, Tripix™, Exterior 400™ series provided by the applicant, Martin Professional A/S. Further LEDs are also being integrated into projecting systems where an image is created and projected towards a target surface, for instance like in the products MAC 350 Entour™ or Exterior 400 Image Projector™ also provided by the applicant, Martin Professional.

WO 2006/113745 discloses a lighting apparatus comprises a light panel having a panel frame, and a plurality of LEDs or other light elements secured to the panel frame. Lenses and/or filters are adjusted in distance from the light elements, by for example moving the lenses/filters into different slot positions of the frame, to alter characteristics of the emitted light. Focal lenses, diffusion lenses, and color filters may be used individually or in combination. A compound lens includes lens elements having different focusing characteristics arranged in a pattern can be arranged in front of the LEDs and movement of the compound lens results in synchronously movement of the different lens elements in respect to the LED. AS a consequence the focal or spread of the light changed by the different lens elements will change simultaneously. Through groupwise control of the intensity of the light elements, the different characteristics are emphasized or de-emphasized.

WO 2007/049176 discloses a plurality of light emitting diode dies (LED) with associated secondary optics, which produce different light distribution patterns, are combined to produce an efficient light source having a desired illumination pattern. By way of example, a first LED may include a lens that produces a light distribution pattern with a maximum intensity at the center while a second LED may use a lens that produces a light distribution pattern with a maximum intensity that surrounds the maximum intensity of the pattern produced by the first LED. The light from the LEDs can then be combined to produce a desired illumination pattern. Additional LEDs and lenses, e.g., having different light distribution patterns may be used if desired. Moreover, a variable current driver may be used to vary the amount of current to the different LEDs, such that the combined illumination pattern may be varied as desired.

WO 2010/084187 discloses a spotlight comprising light emitting diode modules wherein each LED module comprises at least two light emitting diodes with different light emission spectra and a light mixer, wherein each light mixer is arranged at one side of the light mixer in cooperation with an assigned LED module and each light mixer is configured to mix the different light emission spectra of the at least two LEDs of the assigned LED module to form a light beam, and wherein exit surfaces at the other side of the light mixers are arranged next to each other in a matrix with its light beams of the light mixers form a common light beam and a focusing optics for focusing the common light beam.

It is common to incorporate midair light effects into light shows. Midair effects are created by creating a well-defined light beam which is partially scattered by haze or smoke particle in the air whereby the audience can see the light beam in the air. The midair light beams are often created in the head of a moving head light fixture where the head is rotatable connected to a yoke which is rotatable connected to a base and the light beam can as a consequence be moved around in the air. Typically midair light effects are created by profile moving heads comprising projecting systems as these created a bright well defined light beam or by a hybrid of a projecting and a wash system often called beam systems. Typically beam systems has focusing properties like a projecting system, however the focusing in beam systems is not as sharp as dedicated projecting systems and the beams systems creates a more narrow light beam compared to wash lights. There is today a number of different products (e.g. The MAC 250 Beam™ or the MAC 2000 Beam™ provided by Martin Professional A/S) which is cable of providing such light beams and many of these can generate light beams with variable beam diverges and/or collimated light beams having variable beam diameter's. In beam systems, the light beam can be split into multiple numbers of light beams by incorporating prisms having a number of facets into the optical system or by incorporating gobos having a number of smaller apertures. As a consequence the multiple light beams are substantially identical. Further Beam systems are based on traditional light sources as discharge lamps as midair effect requires very bright light beams having relatively narrow beam properties and LEDs have not previously by used when creating beam systems.

WO 2013/060329 A1 discloses an illumination device comprising a number of light sources arranged in at least a first group of light sources and in a second group of light sources, where said first group of light sources and said second group of light sources are individually controllable. First and second optical means collect light from the first and second group of light sources and convert the collected light into a number of first and second light beams. The illumination device comprises further first and second zoom optics adapted to change the beam diverges and/or width of respectively the first and second light beams and the illumination device is capable of controlling the first and second zoom optics individually. This setup makes it possible to control the zoom level of the first and second light beams independently of and at the same time control the light created by the first and second groups of light sources. The consequence is that a new and interesting midair light effect can be created as a multiple color light beam is provided where the divergence and/or beam width of the different colored light beam parts can be varied dynamically and in relation to each other. Providing two or more independent zoom systems increases the cost of such product and it is only possible to control the divergence of the light beams.

EP2428720 discloses a light fixture, which has a plurality of lighting elements, such as eyeball LED lighting elements, mounted in a support plate. Through mechanical engagement with directing plate, which is able to move linearly or translationally in its plane, each LED lighting element can be simultaneously rotated to move the beam axis (A) of each lighting element in the same direction and through the same angle, thereby directing the light fixture beam axis (F). A second embodiment is disclosed in which the lighting elements are movable in a convergent and divergent manner by means of a rotatable cam plate which rotates the lighting elements such that their beam axes move in radial planes extending from a central focus point. The invention provides convenient, low-profile mechanisms for directing or focusing movable lighting elements in a light fixture.

WO07007271 discloses an illumination system has an array of light sources arranged in a pre-determined manner in a first plane, wherein $d_{source}$ is a characteristic dimension of the spatial arrangement of the light sources in the first plane. An array of associated lenses is arranged in substantially the same pre-determined manner in a second plane. Each lens has substantially the same focal distance $f_{lens}$. The array of lenses is provided at a plane distance $d_{plane}$ from the array of light sources. The plane distance $d_{plane}$ is substantially equal to the focal distance $f_{lens}$ of the lenses. The illumination system has displacement means for displacing the array of lenses with respect to the array of light sources so as to obtain a plurality of directional light beams projecting spots on a projection plane arranged at a projection distance $d_{projection}$ from the illumination system, wherein $d_{projection}=10\times d_{source}$ and $d_{projection}=10\times d_{plane}$.

US 2012/021244 disclose a variable focus illuminator including an array of light sources and a movable lens plate positioned immediately in front of the array of light sources. The lens plate includes a plurality of lenses that redirect the light produced by the light sources, such that different positions of the lens plate result in different sizes of the field illuminated by the variable focus illuminator. The lens plate may be movable in translation, rotation, or both. The variable focus illuminator may also include a cover plate in front of the movable lens plate, which may also include a plurality of cover plate lenses. The variable focus illuminator may be varifocal, or may include a zoom capability. The variable focus illuminator may be part of a system that includes a camera, and the system may also include a pan/tilt mechanism. The lens plate has gear teeth molded into its peripheral edge and a motor having a shaft on which a pinion gear is mounted is configured to rotate the lens plate, as the pinion gear engages with the gear teeth of the lens plate. A number of guide pins protrude radially from the lens plate and engage angled grooves As the lens plate rotates the guide pins moves in the angled grooves and cause lens plate to also move toward or away from LEDs. As a consequence translation and rotation of the lens plate in relation the LEDS are tied together.

In general light designers and producers continuously try to create and use new and interesting light effects in the light shows and there is thus a demand for illumination devices introducing new and controllable light effects whereby the light designers can create their own and new light effects.

DESCRIPTION OF THE INVENTION

The object of the present invention is to solve the above described limitations related to prior art and provide a beam system which can create new and interesting midair effects and which also can be based on LEDs. This is achieved by an illumination device and method as described in the independent claims. The dependent claims describe possible embodiments of the present invention. The advantages and benefits of the present invention are described in the detailed description of the invention.

DETAILED DESCRIPTION OF THE INVENTION

The present invention is described in view of a moving head lighting fixture including a number of LEDs that generate a light beam, however the person skilled in the art realizes that the present invention relates to illumination devices using any kind of light source such as discharge lamps, OLEDs, PLEDs, plasma sources, halogen sources, fluorescent light sources, etc. and/or combinations thereof. It is to be understood that the illustrated embodiments are simplified and illustrate the principles of the present invention rather than showing an exact embodiment. The skilled person will thus understand that the present invention can be embodied in many different ways and also comprise further components in addition to the shown components.

Figure 1A:
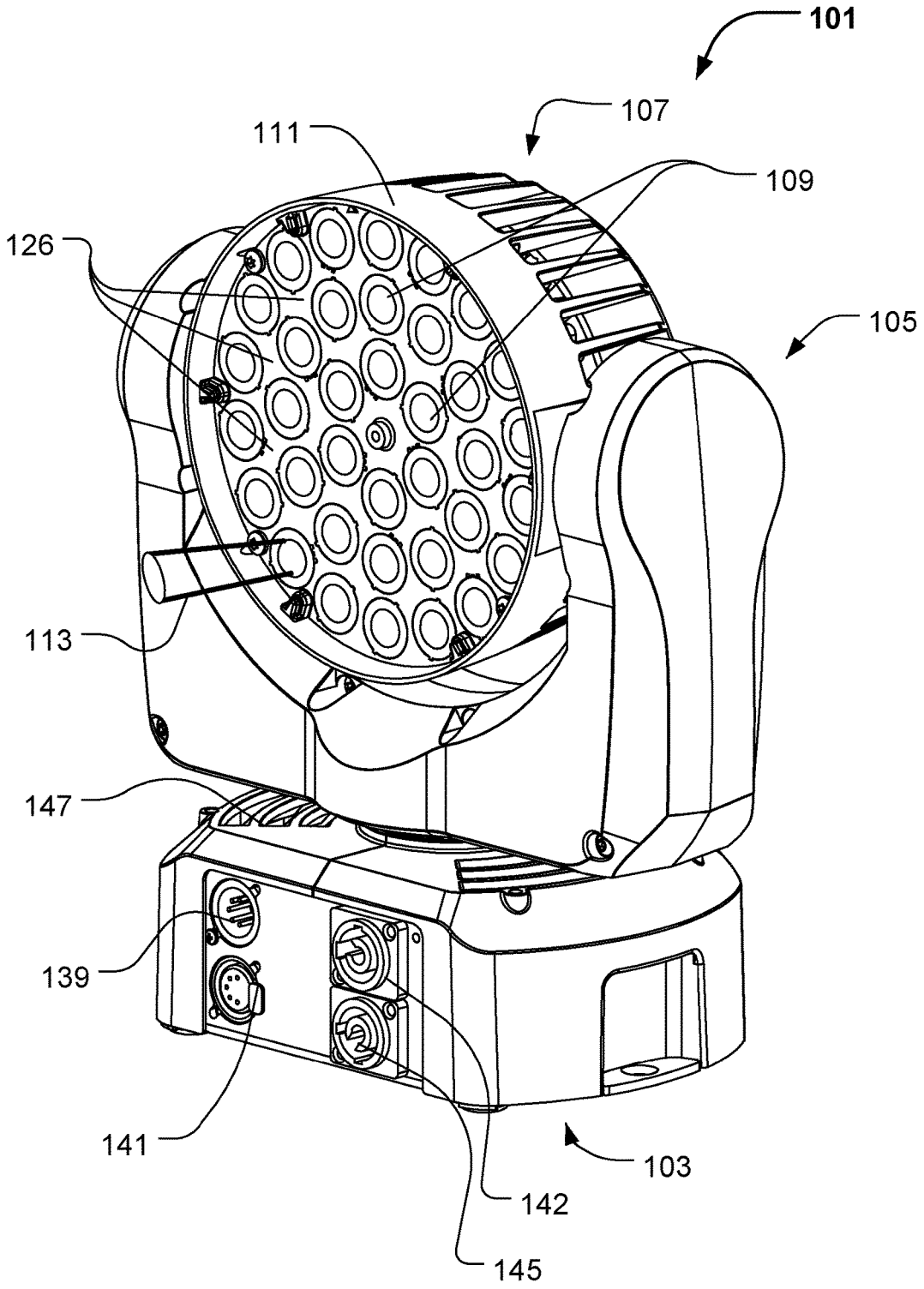
Fig. 1a (Prior art)
FIGS. 1*a* and 1*b* illustrate an example of a moving head lighting fixture according to prior art.
Figure 1B:
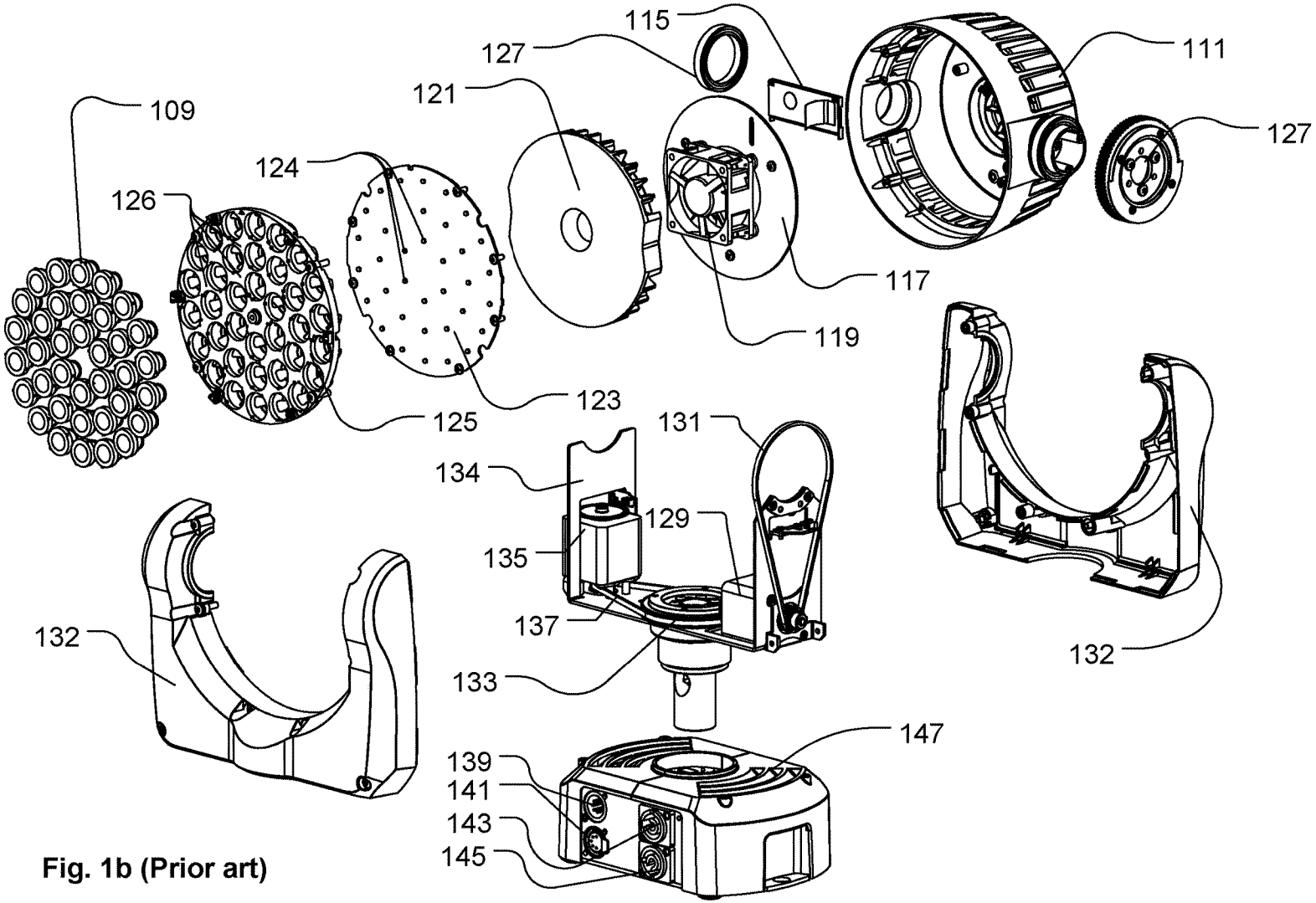
Fig. 1b (Prior art)

FIG. 1*a*-1*b* illustrate an illumination device according to prior art, where FIG. 1*a* is a perspective view and FIG. 1*b* is an exploded view. The illumination device is a moving head lighting fixture 101 comprising a base 103, a yoke 105 rotatable connected to the base and a head rotatable connected 107 to the yoke.

In the illustrated embodiment, the head comprises a number of light sources and a number of light collecting means 109 arranged in the head housing 111. The light collecting means collect light from the at least one of light sources and convert the collected light into a number of source light beams 113 (only one illustrated), and which are emitted from the housing.

In the illustrated embodiment the head housing 107 is a "bucket" shaped head housing 111 wherein a display 115 (visible from the rear side of the head), main PCB 117 (Printed Circuit Board), a fan 119, a heat sink 121, a LED PCB 123, and a lens assembly are stacked. The LED PCB 123 comprises a number of LEDs 124 and the lens assembly comprises a lens holder 125 and a lens array where the lenses constitute the light collecting means 109. Each light collecting means is adapted to collect light from each LED and convert the collected light into a light source beam 113. The head is rotatable connected to the yoke by two tilt bearings 127, which are supported by the yoke 105. A tilt motor 129 is adapted to rotate the head through a tilt belt 131 connected to one of the tilt bearings 127. The yoke comprises two interlocked yoke shell parts 132 which are mounted to a yoke frame 134 whereon the tilt bearings, tilt motor, pan motor and pan bearing are arranged. The LED PCB 123 comprises a number of LEDs emitting light and which in cooperation with the light collecting means 109 in the lens array generate a number of light source beams. The main PCB comprises controlling circuits and driving circuits (not shown) for controlling the LEDs as known in the art of illumination devices. The main PCB comprises further a number of switches (not shown) which extend through a number of holes in the head housing 111. The switches and display act as a user interface allowing a user to communicate with the moving head lighting fixture.

The yoke are connected to a pan bearing 133 rotatable connected to the base 103. A pan motor 135 is adapted to rotate the yoke through a pan belt 137 connected to the pan bearing 133. The base comprises 5-Pin XLR male 139 and female 141 connectors for DMX signals as known in the art of entertainment lighting; input 143 and output power 145 connectors, power supply PCB's (not shown) and fan (not shown). The fan forces air into the base through vent holes 147.

This prior art illumination device uses multiple LEDs to replace a single light source as known prior the introduction of the LED component as a widely used light source. However such illumination device changes its visible appearance as the multiple light sources are now exposed to the viewer and the light emits from a larger area. If the light luminaries are a color mixing version with single color LEDs, then all LED colors used are visible. However some customers dislike the look of multiple light dots. Instead a more uniform, even light exit is requested, to avoid the cheap looking "funfair" look with an extreme amount of light sources. The light beams merges into one common light beam a distance from the light collecting means. When it comes to midair effects such illumination device can only create well-defined light beams having the same color. It is noted the some prior art illumination systems like the one in FIGS. 1*a* and 1*b* can comprise a zooming system enabling the user to adjust the divergence of the light beam. The illuminating device illustrated in FIGS. 1*a* and 1*b* is just one example of a prior art illumination derive and the skilled person realize that a large number of different embodiments provided by a large number of manufactures exits.

FIGS. 2*a*-*d* illustrate a simplified embodiment of the illumination device 201 according to the present invention. FIG. 2*a*, 2*c*, 2*e*, 2*g* illustrate a top view and FIG. 2*b*, 2*d*, 2*f*, 2*h* illustrate a cross sectional view along line A-A in respectively FIG. 2*a*, 2*c*, 2*e*, 2*g*.

The illumination device 201 comprises a plurality of light sources arranged in a first group of light sources 203 (illustrated as black quadrangles) and in a second group of light sources 205 (illustrated as white quadrangles). In this embodiment the light sources are LEDs mounted on a PCB 207 (printed circuit board) and the two groups of light sources can be controlled individually and independently by a controller (not shown) as known in the art of intelligent lighting. The skilled person realizes that each group of light sources also can be divided into a number of sub-groups, which also can be controlled individually and that it is also possible to control each single light source individually.

A plurality of optical means 209 are adapted to collect light from the light sources and to convert the collected light into a number of source light beams. The first group of light sources and the associated optical means generate a plurality of first source light beams and the outer perimeters of the first light source beams are indicated by solid lines 213. Similar the second group of light sources and the associated optical means generate a plurality of second source light beams and the outer perimeters of the second light beams are indicated by dashed lines 215. The source light beams propagate along an optical axis 212.

The mentioned components are arranged in a housing 210 and the first and second light beams are emitted from the housing. The optical means can be embodied as any optical component capable of collecting light from the light sources and convert the light into light beams and can for instance be optical lenses, light mixers, TIR lenses etc.

The illumination device comprises zoom means 217 adapted to move the optical means 209 along the primary optical axis 212 and in relation to the light sources, whereby the diverges of the light beams changes. FIG. 2*a*-2*d* illustrate settings where the zoom means 217 have arranged the optical means in a distance from the light sources where narrow light source beams are generated. FIG. 2*e*-2*f* illustrates a setting where the zoom means 217 have arranged the optical means in a distance from the light sources where wide light source light beams are generated.

The illumination device comprises rotating means 218 adapted to rotate the optical means 209 in relation to the light sources. FIG. 2*a*, 2*b*, 2*e*, 2*f* illustrate a setting where the rotating means have arranged the optical means in a position where the optical axes of the each optical means have been arranged above (or aligned with) the optical axis of a corresponding light source. FIG. 2*c*, 2*d*, 2*g*, 2*h* illustrate a setting where the rotating means 218 have arranged the optical means in a position where the optical axes of each optical means have been displaced in relation to the optical axis of a corresponding light source.

The consequence is that a new and interesting light effect can be created, as flower effects can be provided by rotating the optical means in relation to the light sources. This is achieved as the light source beams are refracted in relation to the optical axis when the optical means is rotated around the primary optical axis 212. Hereby a large number of patterns can be created at a target surface where the light source beams hits. The rotating means can rotate the optical means continuously around the optical axis whereby the source light beams are move dynamically in relation to the primary optical axis 212. By dividing the light sources into at least a first group of light sources and a second group of light sources makes it possible to provide light source beams of multiple colors which again make it possible to generate new light effects. The second group of light sources are arranged in at least one concentric ring surrounding the first group of light sources this makes it possible to create flower effects where the light beams from each group of light sources are refracted in a similar way in relation the primary optical axis and symmetric looking patterns can hereby be create.

Figure 3A:
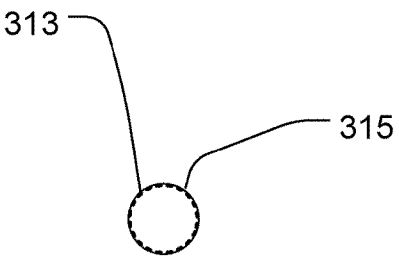
FIGS. 3*a*-3*d* illustrate simplified illumination created at a target surface by an illumination device according to the present invention.
Figure 3B:
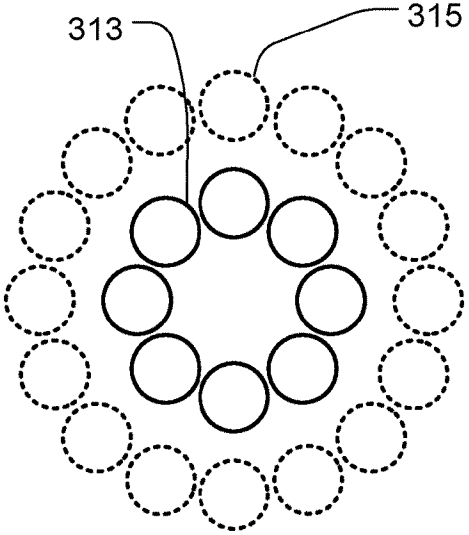
Figure 2B:
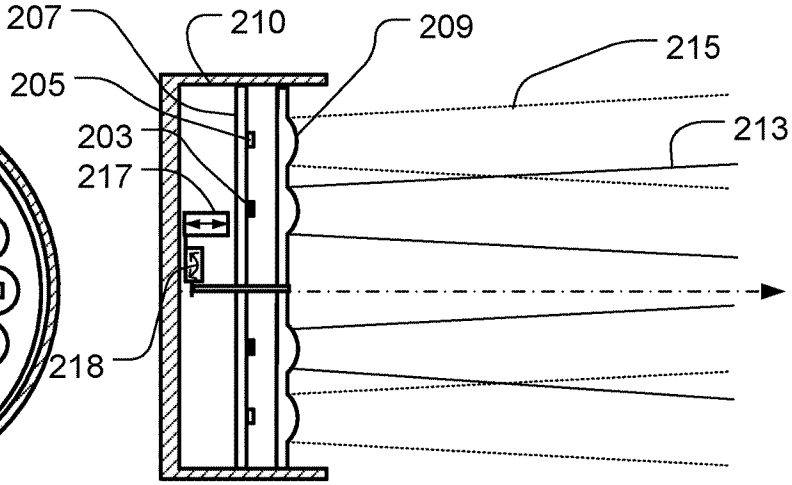
FIGS. 2*a*-2*h* illustrate an embodiment of an illumination device according to the present invention.
Figure 2A:
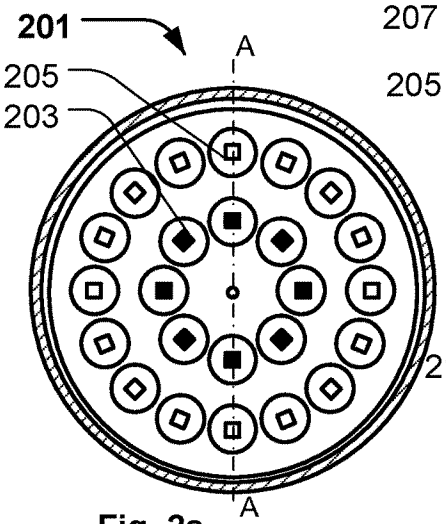
Figure 2D:
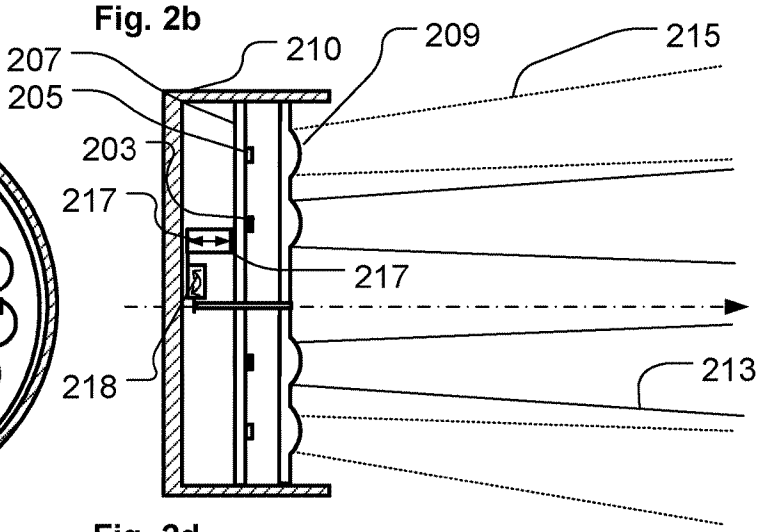
Figure 2C:
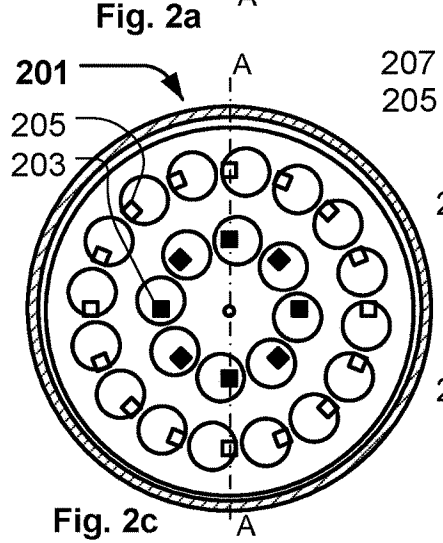
Figure 3C:
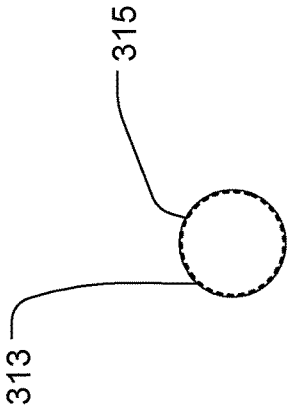
Figure 3D:
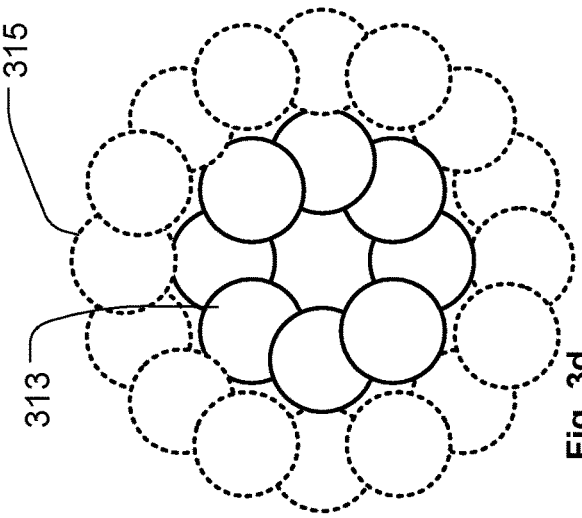
Figure 2F:
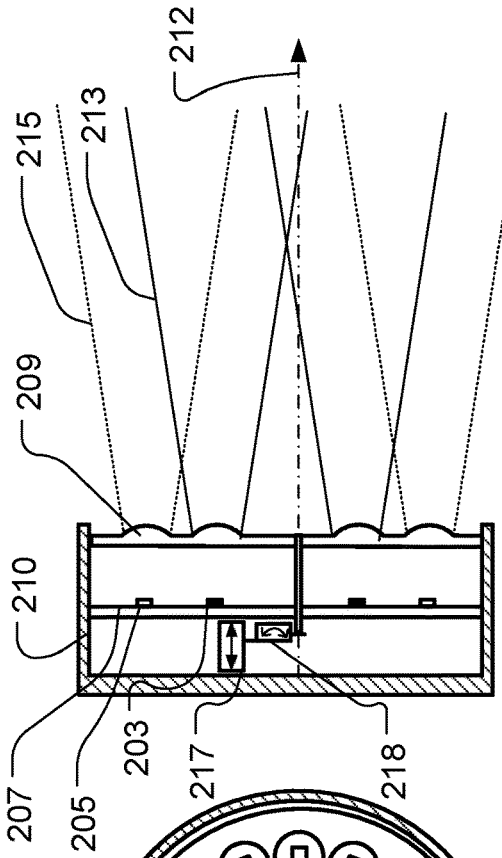
Figure 2E:
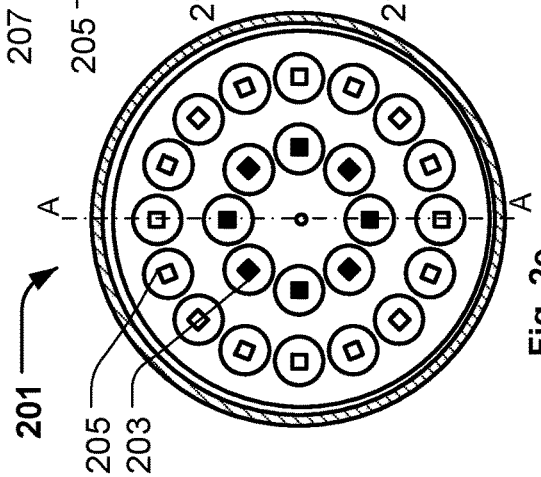
Figure 2H:
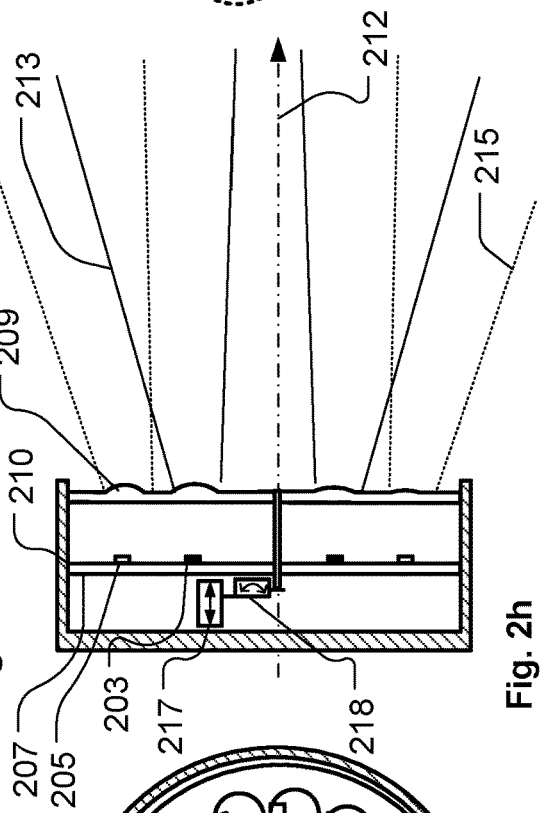
Figure 2G:
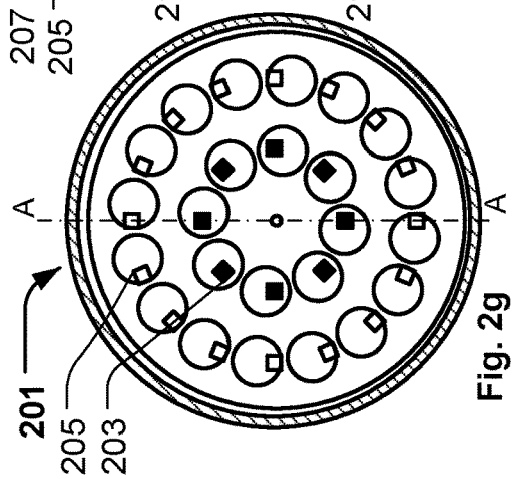

FIG. 3*a*-3*d* illustrates the spots of the resulting light beams at a distance far away (+5 meters) from the illumination device, where FIG. 3*a* illustrates the spots of the setting in FIGS. 2*a* and 2*f*; FIG. 3*b* illustrates the spots of the setting in FIGS. 2*c* and 2*d*; FIG. 3*c* illustrates the spots of the setting in FIGS. 2*e* and 2*f* and FIG. 3*d* illustrates the spots of the setting in FIGS. 2*g* and 2*h*. Solid circles 313 illustrate the spots created by the first source light beams from the first group of light sources and dashed circles 315 illustrated the spots created by the second source light beams from the second group of light sources. FIG. 3*a* illustrates that, in the narrow setting and with the optical means above the light sources, a small spot is generated and that far away from the illumination device the light source beams will hit approximately the same area. FIG. 3*b* illustrates that, in narrow setting and with the optical means displaced in relation to the light sources, the spots of the light source beams are separated and can be seen as individual light spots. Rotating the optical means in relation the light sources provides dynamic light effects where the spots of the light sources moves. FIGS. 3*c* and 3*d* illustrates similar effects with the optical means in wide setting which causes the spot of the light source beams to increase.

As a consequence it is possible to move the spots of the light source beams by rotating (using the rotating means) the optical means in relation the to the light sources and at the same time also to change to size of the spots by moving the optical means (using the zoom means) along the optical axes in relation to the light sources. The skilled person realizes that the illumination device also can be used to create new mid-air effect The skilled person realize also that the first and second source light beams may overlap in some zones and that an observer will observe these zones as a combination of the color of the first source light beam and the color of the second source light beam as known in the art of additive color mixing. For instance in the case that the first source light beam is green and that the second source light beam is red and they are run at approximately the same intensity (as observed by a human) then a human observer would see the overlapping zones as yellow. This can be used to divide the common light beam into further zones having a mixed color. If desired, it is also possible to minimize the appearance of mixed areas/sections by driving one of the light beams at a higher intensity than the other as the most intense light beam now will be the dominating and the less intense light beam will only be observed in non-overlapping zones. The person skilled in optics will also be able to define the optics such that the amount of overlapping zoned are minimized for instance by designing the first and second optical means such that the first and second light are substantially aligned adjacent to each other in the entire zooming range.

Figures 4A, 4B, 4C, 4D:
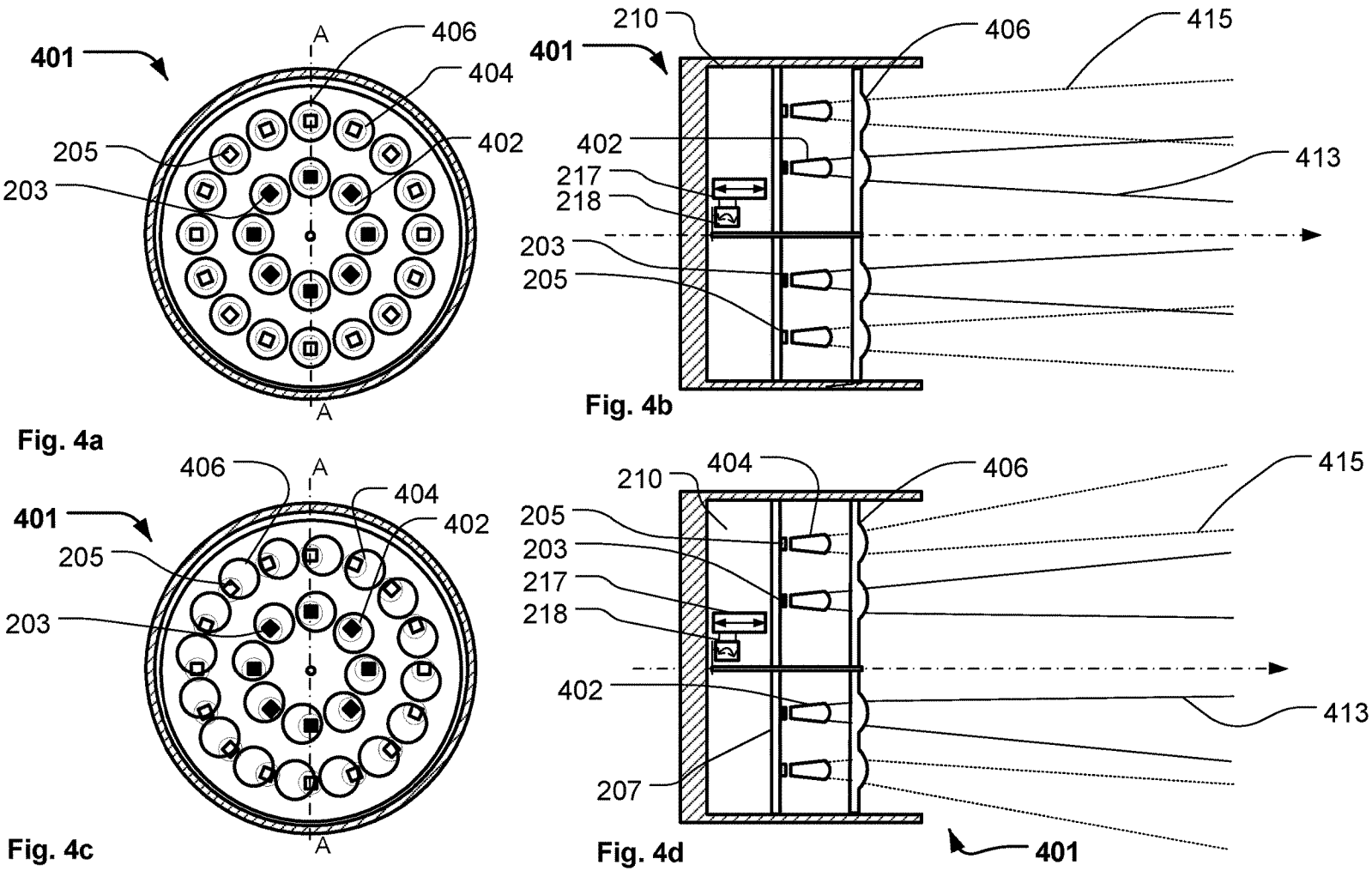
FIGS. 4*a*-*d* illustrate another embodiment of an illumination device according to the present invention.

FIGS. 4*a*-*d* illustrate another simplified embodiment of the illumination device 401 according to the present invention. FIGS. 4*a* and 4*c* illustrate a top views and FIGS. 4*b* and 4*d* illustrate a cross sectional view along line A-A in respectively FIGS. 4*a* and 4*c*. This illumination device is substantially identical to the illumination device illustrated in FIG. 2*a*-2*h* and substantial identical features are labeled with the same reference numbers and will not be described in connection with FIG. 4*a*-4*d*.

In this embodiment the optical means comprises light collecting means 402, 404 and zoom optics 406. The light collecting means 402, 404 are adapted to collect light from light sources and to convert the collected light into a plurality of intermediate light beams and the zoom optics 406 are adapted to collect the intermediate light beams and diffract the intermediate light beams into the light source beams emitted from the housing. First light collecting means 402 are adapted to collect light from the first group of light sources 203 and to convert the collected light into the first intermediate light beams and where the zoom optics 406 receives the first intermediate light beams from the first light collecting means 402. Similarly the second light collecting means 404 are adapted to collect light from the second group of light sources 205 and to convert the collected light into the second intermediate light beams and where the optical means 406 receives the second intermediate light beams from the second light collecting means 404. The exit surface of the first and second light collecting means are indicated by dotted circles in FIGS. 4*a* and 4*c*. As a consequence a number for first light source beams 413 and second light source beams 415 are created. The first 402 and second 404 light collecting means can be embodied as any optical component capable of collecting light from the light sources and convert the light into light beams and can for instance be optical lenses, light mixers, TIR lenses etc. The first 402 and second 404 light collecting means can collect much of the light from the light sources and form a number of intermediate light beams which can be adjusted by optical means as described above. In the case that the light sources are multiple die LEDs having dies emitting different colors, the light collecting means can be embodied as light mixers capable of mixing the light form the different dies into a homogenized light beam. In this embodiment the zoom means 217 is adapted to move the zoom optics 406 along the primary optical axis 212 and in relation to the first 402 and second 404 light collecting means. Further the rotating means 218 is adapted to rotate the zoom optics 406 in relation the first 402 and second 404 light collecting means where by similar light effects as describe in connection with FIG. 2*a*-2*h* can be created.

Figure 5:
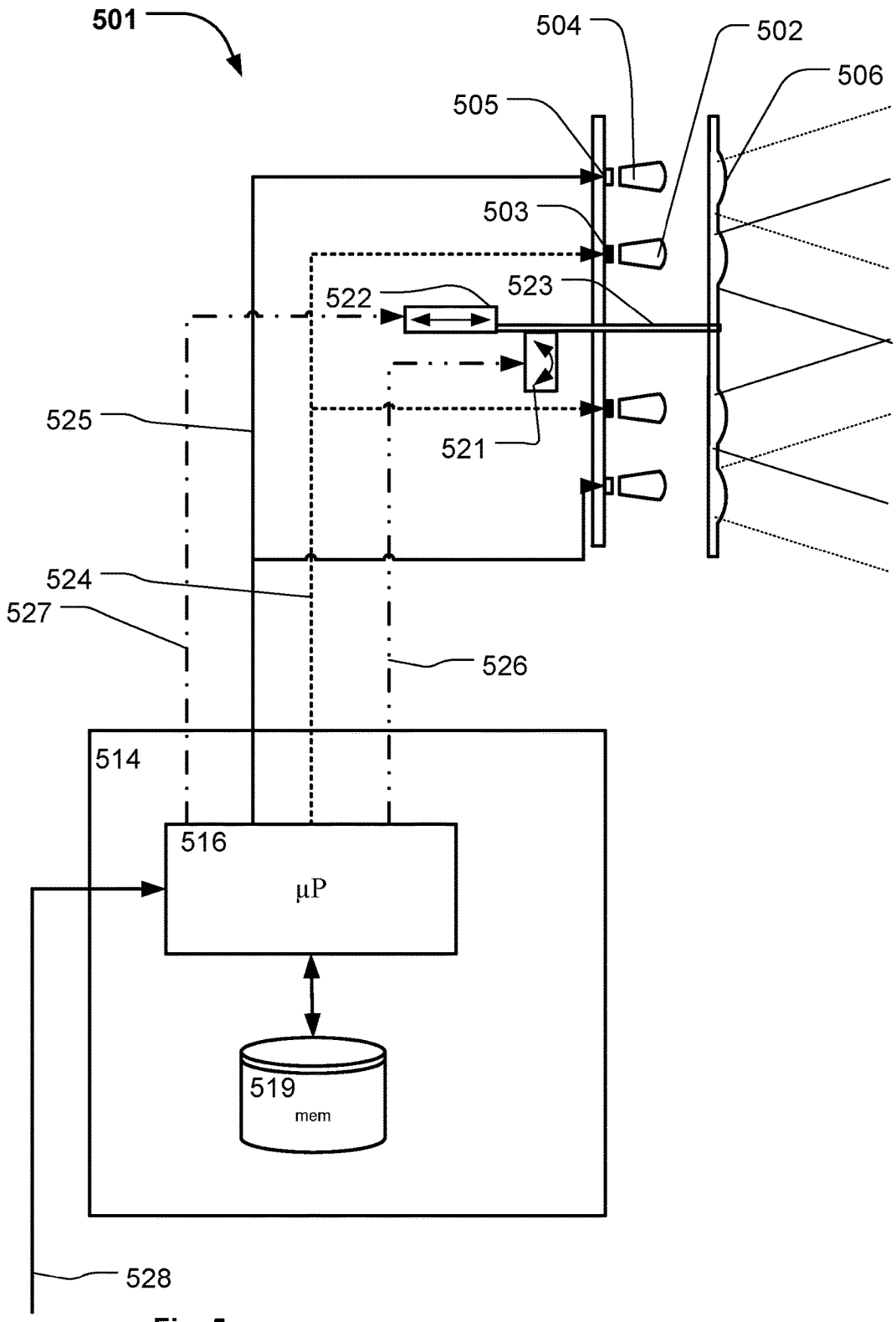
FIG. 5 illustrates a structural diagram of an illumination device according to the present invention.

FIG. 5 illustrates a block diagram of an illumination device 501 according to the present invention. Similar to the illuminations device 401 shown in FIG. 4*a*-4*b*, the illumination device 501 comprises a number of light sources arranged in a first group of light sources 503 (black) and in a second group of light sources 505 (white). First 502 and second 504 light collecting means are arranged between the light sources and the zoom optics 506. The first group of light sources are arranged as a ring around the second group of light sources. Each of the first and second groups of light sources are embodied as a multi-die LEDs comprising a number of dies emitting different color, e.g. a red die emitting red light, a blue light emitting blue light, a green die emitting green light and a white die emitting white light, however the skilled person realize that many combinations of such multi-die LED can be used. The light collectors are embodied as light mixers mixing the light from each multi-die LED into a homogeneous light beam. The light mixers can for instance be embodied as any light mixer known in the art for instance polygonal or circular light rods, conical light mixers or as described in the Danish patent application DK PA 2010 70580 titled "OPTICAL LIGHT MIXER PROVIDING A HOMOGENIZED AND UNIFORM LIGHT BEAM" filed the 23 Dec. 2010 or in the in the PCT patent application PCT/DK2011/050450 titled "OPTICAL LIGHT MIXER PROVIDING A HOMOGENIZED AND UNIFORM LIGHT BEAM" filed the 25 Nov. 2011 and published as WO 2012/083957. Both applications have been filed by the applicant and are incorporated herein by reference. The zoom optics 506 is connected to a central axle 523 which can be rotated by a rotating actuator 521 and moved along the optical axes by a zoom actuator 522.

The illumination device comprises further a control unit 514 comprising a processor 516 and a memory 519. The processor acts as controlling means and is adapted to control the first group of light sources 503 and the second group of light sources 505 respectively through communication means 524 (in dashed lines) and 525 (in solid lines). The processing means can thus control one of the groups of light sources without controlling the other group of light sources. The controlling means can for instance be adapted to control the color and/or intensity of the light sources and can be based on any type of communication signals known in the art of lightning e.g. PWM, AM, FM, binary signals etc. The first 503 and second 505 group of light sources can thus be controlled individually and independently and can thus be treated as two individually and independently groups of light sources. It is to be understood that the individually light sources of each groups can be controlled by the same control signal, supplied with individual control signals and/or grouped in sub-groups where each subgroup receive the same control signal. The communication means 524 and 525 are illustrated as three connections divided into the individual light source, however the skilled person will be able to construct many embodiments of the communication means, for instance the group of light sources may be coupled in series or in parallel. Alternatively both groups of light sources can be connected to the same data bus and controlled by the controller through a data bus using addressing. Further the controlling means is adapted to control a rotating actuator 521 actuator and a zoom actuator 522 respectively through communication means 526 (in dashed-dotted line) and 527 (in dashed-dotted-dotted) by sending instructions to the rotating and zoom actuators. These instructions can instruct zoom actuator to move optical means whereby the divergence of light source beams can be changed. Further instructions can instruct rotating actuator to rotate optical means around the optical axis whereby the light source beams are refracted in relation to the optical axis. As described above the illumination device is thus capable of creating many new and exciting mid-air effects and can also provide interesting light effects on a surface where on the light beam are projected.

The controlling means can be adapted to control the zoom actuator 522 based on a first zoom level parameter. The zoom level parameter is indicative of the zoom level of the light source beams and can for instance be stored in the memory or determined based on parameters. The zoom level parameter can also be received through an input signal 528 as described below. Similar the controlling means can be adapted to control the rotating actuator 521 based on a rotating parameter. The rotating parameter can be indicative of the rotation speed of the optical means, an angular position of the optical means in relation the light sources or a reference position, the direction of rotation etc. The rotation parameter can for instance be stored in the memory or determined based on other parameters. The rotation parameter can also be received through an input signal 528 as described elsewhere in this application. In the illustrated embodiment the controlling means are adapted to activate the zoom actuator 522 and rotation actuator 521 based on the zoom and rotation parameters whereby the optical means can be rotated and moved along the optical axis in relation the light sources and or light collectors.

Further the controlling means can be adapted to control the first group of light sources based on a first color parameter and to control the second group of light sources based on a second color parameter. The first color parameter can for instance be indicative of the color that the first group light sources shall generate, for instance RGB values, color coordinates in color maps etc. Similar the second color parameter can be indicative of the color that the second group of light sources shall generate, for instance RGB values, color coordinates in color maps etc. Alternatively the controlling means can be adapted to control the second group of light sources based on the first color parameter whereby the second group of light sources can be adapted to generate substantial the same color as the color generated by the first group of light sources the light beams will in this way have the same color and appear as one common light beam and the illumination device can thus be used as a prior art illumination device. However it is also possible to integrate a color scheme such that the color of the second array is adjusted such that the color of the second group of light sources is different but esthetic matches each other according to a predetermined color scheme. Similar the first group of light sources can be controlled based on the second color parameter.

In one embodiment the controlling means is adapted to control the first group of light sources, the second group of light sources, the zoom actuator and rotation actuator based on an input signal 528 indicative of a number of controlling parameters as known in the art of entertainment lighting. The input signal 528 can be any signal capable of communication of parameters and can for instance be based on one of the following protocols USITT DMX 512, USITT DMX 512 1990, USITT DMX 512-A, DMX-512-A including RDM as covered by ANSI E1.11 and ANSI E1.31 standards or Wireless DMX. ACN designates Architecture for Control Networks; ANSI E1.17—2006) or ArtNet. The input signal can for instance be indicative of the first zoom level parameter; second zoom level parameter; the first color parameter and/or the second color parameter.

A number of predefined effect functions can also be stored in the memory and for instance comprise a number of instructions on how the zoom level of the first and second zoom optical means are regulated in relation to each other. These predefined effect functions can for instance be executed and combined as described in the Danish patent applications DK PA 2011 00665 and DK PA 2011 00666 respectively titled "METHOD OF PRIORITIZING EFFECT FUNCTIONS IN AN ILLUMINATION DEVICE" and METHOD OF SYNCHRONIZING EFFECT FUNCTIONS IN AN ILLUMINATION DEVICE. Both applications filed by the applicant the Sep. 2, 2011 and incorporated herein by reference. Or alternatively as described in the PCT patent application PCT/DK2012/050326 titled "PRIORITIZING AND SYNCHRONIZING EFFECT FUNCTIONS" filed the of Aug. 31, 2012 by the applicant and published as WO2013029630 and incorporated herein by reference.

The illumination device according to the present invention can also be integrated with an illumination device as described in the patent application, PCT/2011/050110 (WO 2011/131197) titled "LED LIGHT FIXTURE WITH BACKGROUND LIGHTING" filed 5$^{th}$ of Apr. 5, 2011 by the applicant and incorporated herein by reference. In such embodiment an additional group of background light sources can be adapted to illuminate diffusing means in areas between the light beams. The background light sources can provide background light between the light beams through a number of light guides as described in the patent application PCT/2011/050112 (WO 2011/131199) titled "LED LIGHT FIXTURE WITH BACKGROUND LIGHT EFFECTS" filed by the applicant the 5$^{th}$ of Apr. 5, 2011. Alternatively the background light sources can constitute pixels in a background display as described in the patent application PCT/2011/050120 (WO 2011/131200) titled "LED LIGHT FIXTURE WITH BACKGROUND DISPLAY EFFECTS" filed by the applicant the 12$^{th}$ of Apr. 5, 2011.

It is noted that the light sources of the first and second groups can be different and the optical properties of the first and second optic means also can be different and that the person skilled in the art of optics can is choosing and/or these components according to specified requirements.

New and interesting eye candy effects when viewing the emitting surface of the illumination device can be created by providing the illuminations device according to the present invention with a set of background light sources adapted to illuminate areas between the optical lenses of the zoom optics 209, 406, 506 as described in the patent applications mentioned in the previous paragraph. In the settings shown in FIG. 2*a*, 2*b*, 2*e*, 2*f* the illumination device will act like the illumination device described in the patent applications mentioned in the previous paragraph. However when rotating the optical means (zoom optics) in relation to the first second and background light sources the lenses of the optical means will start to collect light from the background light sources whereby the lenses of the optical means will be lit up with the light from the background light sources. This can be used to created new eye candy effects for instance by running the first and second light sources at a first color and the background light sources at a second color whereby the candy effect will change dynamically by rotating optical means in relation to the light sources.

Figures 6A, 6B:
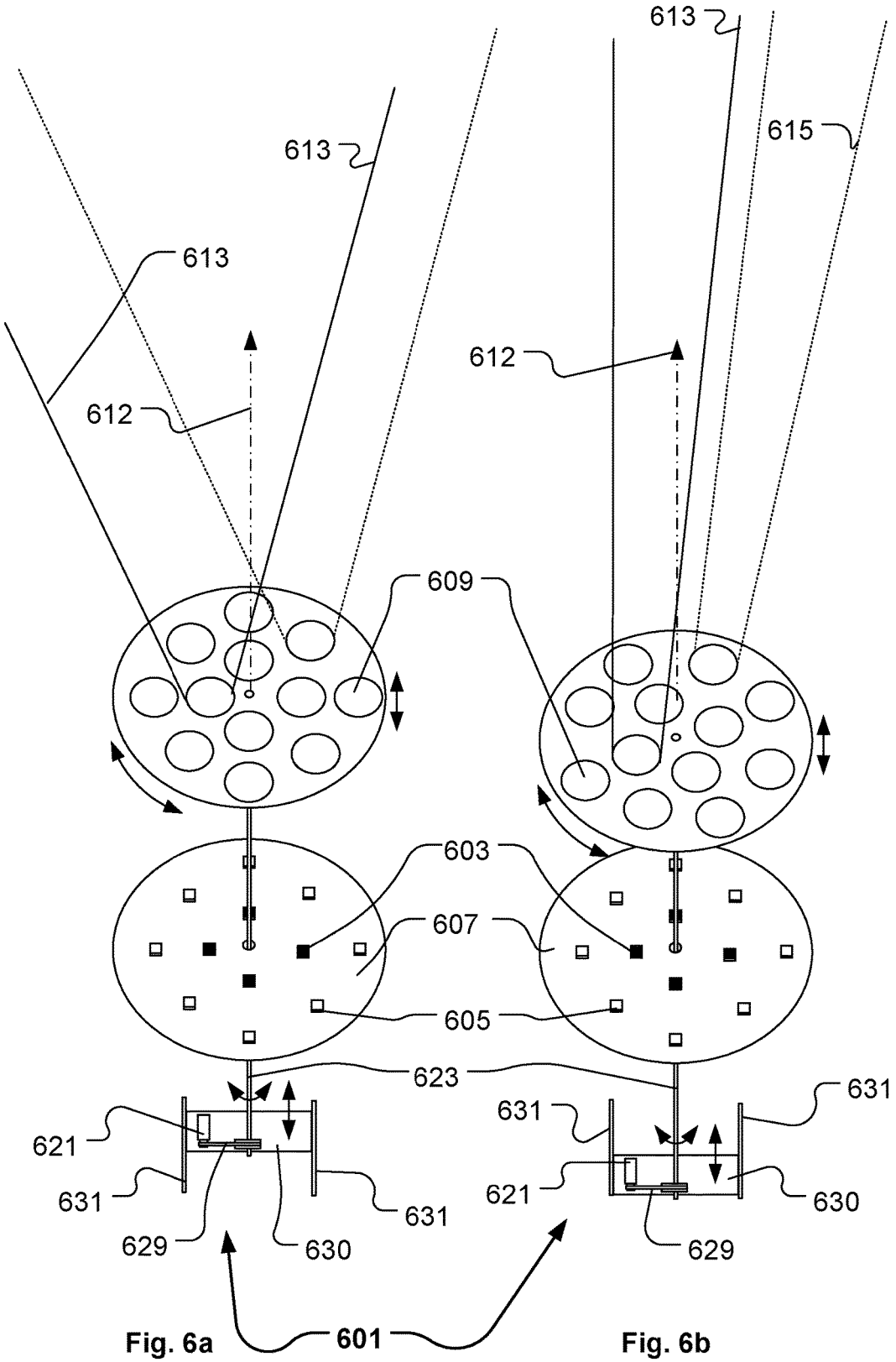
FIGS. 6*a* and 6*b* illustrate an embodiment of an illumination device according to the present invention.

FIGS. 6*a* and 6*b* illustrate another embodiment of the illumination device 601 according to the present invention. FIG. 6*a* illustrates the illumination device in a first setting where the optical means 609 is arranged above the first 603 and second 605 group of light sources light sources and in wide zoom setting (correspond to same setting as shown in FIG. 2*e*, 2*f*, 3*c*) generating wide first 613 and second 615 light source beams. FIG. 6*b* illustrates a setting where the optical means 609 have been displaced in relation the optical axis 612 and in narrow setting (correspond to same setting as shown in FIG. 2*c*, 2*d*, 3*b*) generating narrow first 613 and second 615 source light beams. The first 603 and second 605 groups of light sources are arranged on a LED PCB 607 and are independently controllable as described above.

In this embodiment a rotating actuator 621 has been coupled to a central axle 623 which is attached to a central part of the optical means 609. The central axle is arranging substantial on the optical axis 612. The rotating actuator is coupled to the central axle using a belt mechanism 629, where couplings mechanism such as gears, toothed wheels, chains etc. can be used. Rotating actuator 621 can thus rotate the central axle in relation to the optical axis, whereby the optical means 609 is rotated in relation to the light sources. In this embodiment the rotating actuator 621 and center axle 623 have been arranged on a moving sled 630. The moving sled is movable supported by at least one support track 631, however in the illustrated embodiment two tracks support the moving sled 631. A zoom actuator (not shown) is adapted to move the moving sled 530 in relation to the track 531 whereby the central axes will move the optical means along the optical and in relation to the two light sources. The zoom actuator moves the moving sled along the track using a belt mechanism for instance any of those known from zoom optical where a zoom lens is moved in relation to a front lens and where the zoom lens is mounted on a movable sled which is movable supported by at least one track. Alternatively the zoom actuator can be arranged at the sled and adapted to interact with the tracks.

It is also noticed that the optical means can be divided into a first group of optical means and in a second group of optical means which can be rotated independently of each other in relation to respectively the first group of light sources and the second group of light sources. Hereby it is possible to control the refraction of the first light source beam in relation to the optical axis and the refraction of the second light source beams independently of each other. Further it is possible to provide individual zoom means to the two groups of optical means, for instance as described in the patent application PCT/DK2012/050388 (WO 2013/060329) titled "ILLUMINATION DEVICE WITH MULTI-COLORED LIGHT BEAM" filed by the applicant the 19 Oct. 2012.

Figures 7A, 7B, 7C, 7D:
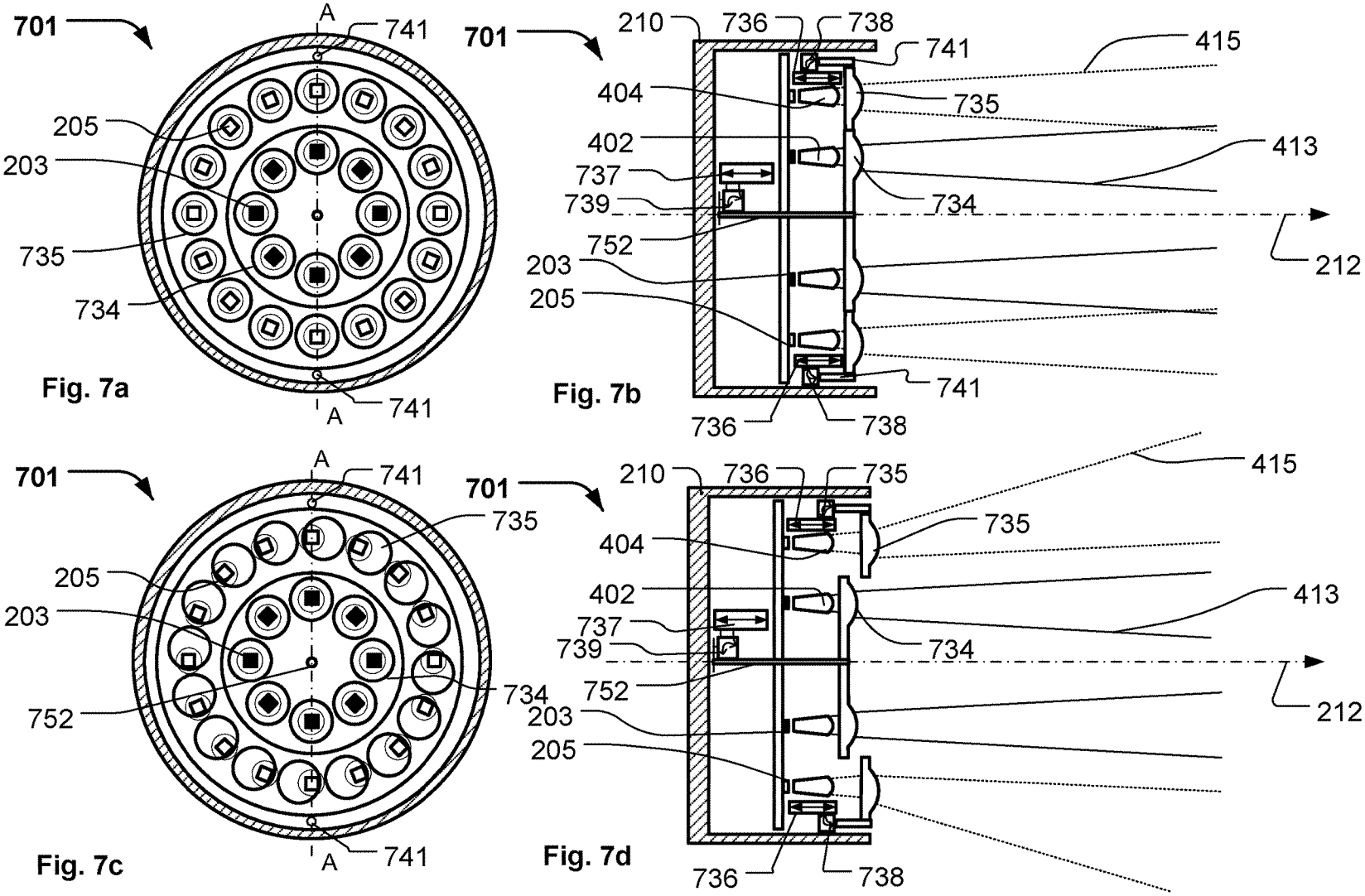
FIGS. 7*a*-7*d* illustrate another embodiment of an illumination device according to the present invention.

FIGS. 7*a*-*d* illustrate another simplified embodiment of the illumination device 701 according to the present invention and where the optical means have been divided into two parts which individually can be rotated and moved along the optical axis individually. FIGS. 7*a* and 7*c* illustrate top views and FIGS. 7*b* and 7*d* illustrate cross sectional views along line A-A in respectively FIGS. 7*a* and 7*c*. This illumination device is substantially identical to the illumination device illustrated in FIG. 4*a*-4*d* and substantially identical features are labeled with the same reference numbers and will not be described in connection with FIG. 7*a*-7*d*. In this embodiment the zoom optics have been divided into a first zoom optics 734 and second zoom optics 735.

The first zoom optics 734 are adapted to collect light from the first group of light sources and to convert the collected light into first source light beams 413. First zoom means are adapted to move the first zoom optics 734 along the optical axis 212 and in relation to the first group of light sources. First rotating means are adapted to rotate the first zoom optics 734 around the optical axis 212 and in relation to the first group of light sources. The first zoom optic 734, first zoom means and first rotating means function thus as described earlier in this application. The zoom means comprises a central zoom axle 752 connected to the first optical means 734 and a first zoom actuator 739 adapted to move the central zoom axle 752 along the primary optical axis. The first rotating means comprises a rotation actuator 736 adapted to rotate the central zoom axle around the primary optical axis. The first rotation actuator 739 and said central zoom axle 752 are arranged on a moving sled and the moving sled is adapted to move along at least one support track, and the zoom actuator is adapted to move the moving sled along the support track.

The second zoom optics 735 are adapted to collect light from the second group of light sources and convert the collected light into second source light beams 415. Second zoom means are adapted to move the second zoom optics 735 along the optical axis 212 and in relation to the second group of light sources. Second rotating means are adapted to rotate the second zoom optics 735 around the optical axis 212 and in relation to the second group of light sources. The second rotating means comprises at least one peripheral rotate axle 741 adapted to engage with the peripheral edge of said second optical means 735 and at least one second rotate actuator 738 adapted to rotate the peripheral rotate axle 741 around an axis substantial parallel with the primary optical axis, whereby the second optical means rotates around said primary axle. The second zoom means comprises a second zoom actuator 736 adapted to move the peripheral axle in a direction substantial parallel with said primary optical axis. The second actuator 738 and the peripheral rotate axle 741 are arranged on a moving sled and the moving sled is adapted to move along at least one support track, and the second zoom actuator 736 is adapted to move the moving sled along the support track. In the illustrated embodiment two sets of second rotating means and second zoom means are arranged opposite each other in relation to the optical axis in order to provide better support of the second zoom optics. However any positive number of rotation actuators can be provided.

FIGS. 7*a* and 7*b* illustrates the first and second zoom optics in a narrow position where the first and second source light beams are narrow. Further in FIGS. 7*a* and 7*b* the first zoom optics are arranged above (aligned with) the first light sources 203 and first light collectors 402. Similar the second zoom optics are arranged above (aligned with) the second light sources 205 and second light collectors 404. In FIGS. 7*b* and 7*c* the first zoom optics have been moved to a wide position where wide first source light beams are generated in addition hereto the first zoom optics have been rotated in relation the first light sources and the first light collectors. The first source light beams are thus refracted away from the optical axis.

The individual control of both the first and second zoom means and first and second rotating means makes it possible to create many new and interesting light effects. This can be achieved by rotating the first and second zoom optics at different speed whereby the moving speed of the first and second source light beams can be varied in relation each other. For instance it is possible to adjust the rotation speed of the first and second zoom optics such that the inner most (in this embodiment the first zoom optic) zoom optics rotates with a faster angular speed than the outermost (in this embodiment the second zoom optics) and such that the innermost and outermost zoom optics will be aligned with the corresponding light sources and light collectors at the same time, as a consequence the spots created by the inner and outer light beams will move at substantially the speed. Further the first and second zoom optics can be rotated opposite ways around the optical axis.

The skilled person realizes that the zoom level parameter described in connection with FIG. 5 can comprise both a first zoom level parameter related to the first zoom means and a second zoom level parameter related to the second zoom level parameter. The control means can be adapted to control the first zoom means based on the first zoom level parameter and the second zoom means based on the second zoom level parameter.

Figure 8A:
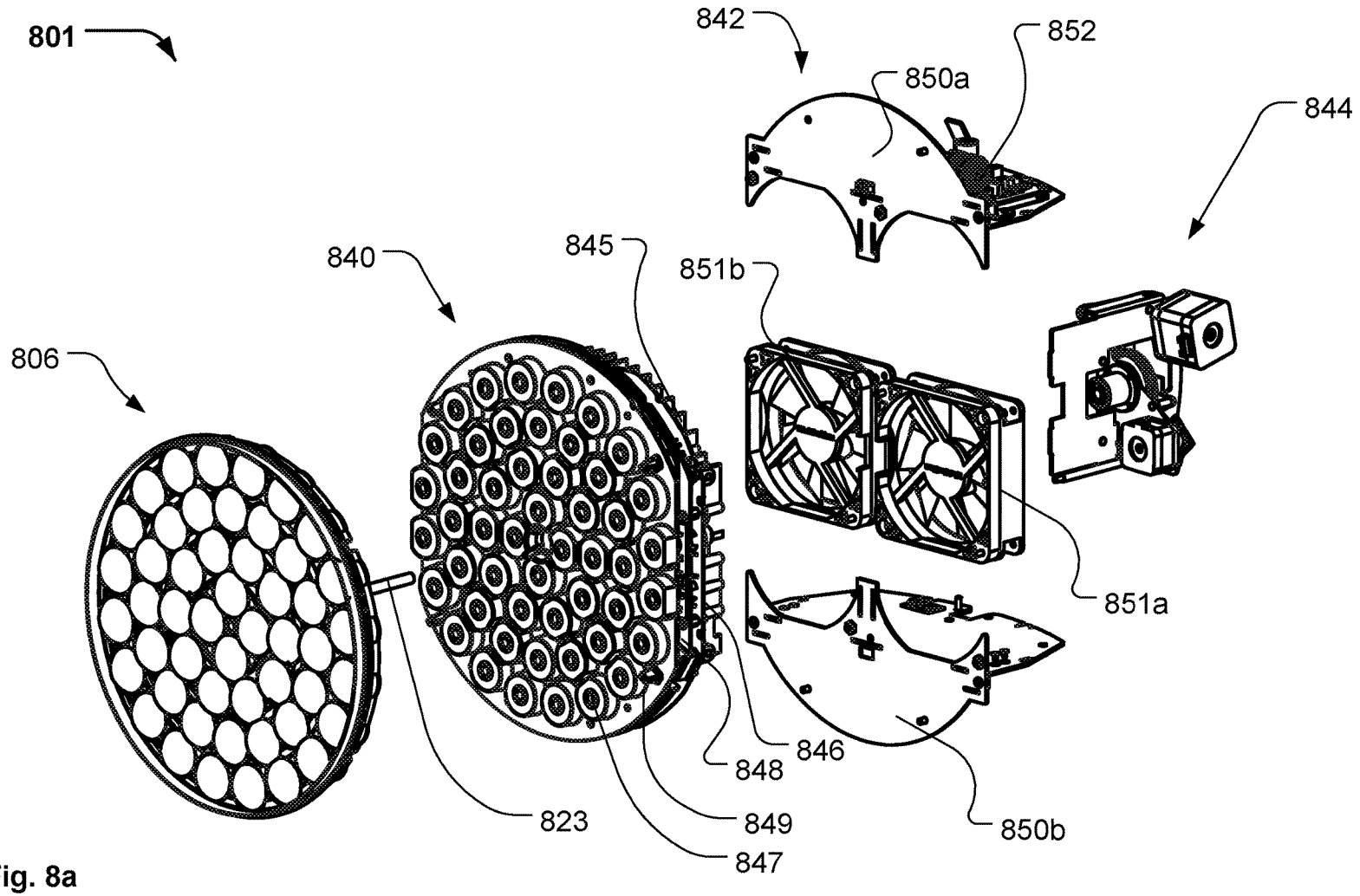
FIGS. 8*a*-8*d* illustrate another embodiment of an illumination device according to the present invention.
Figure 8B:
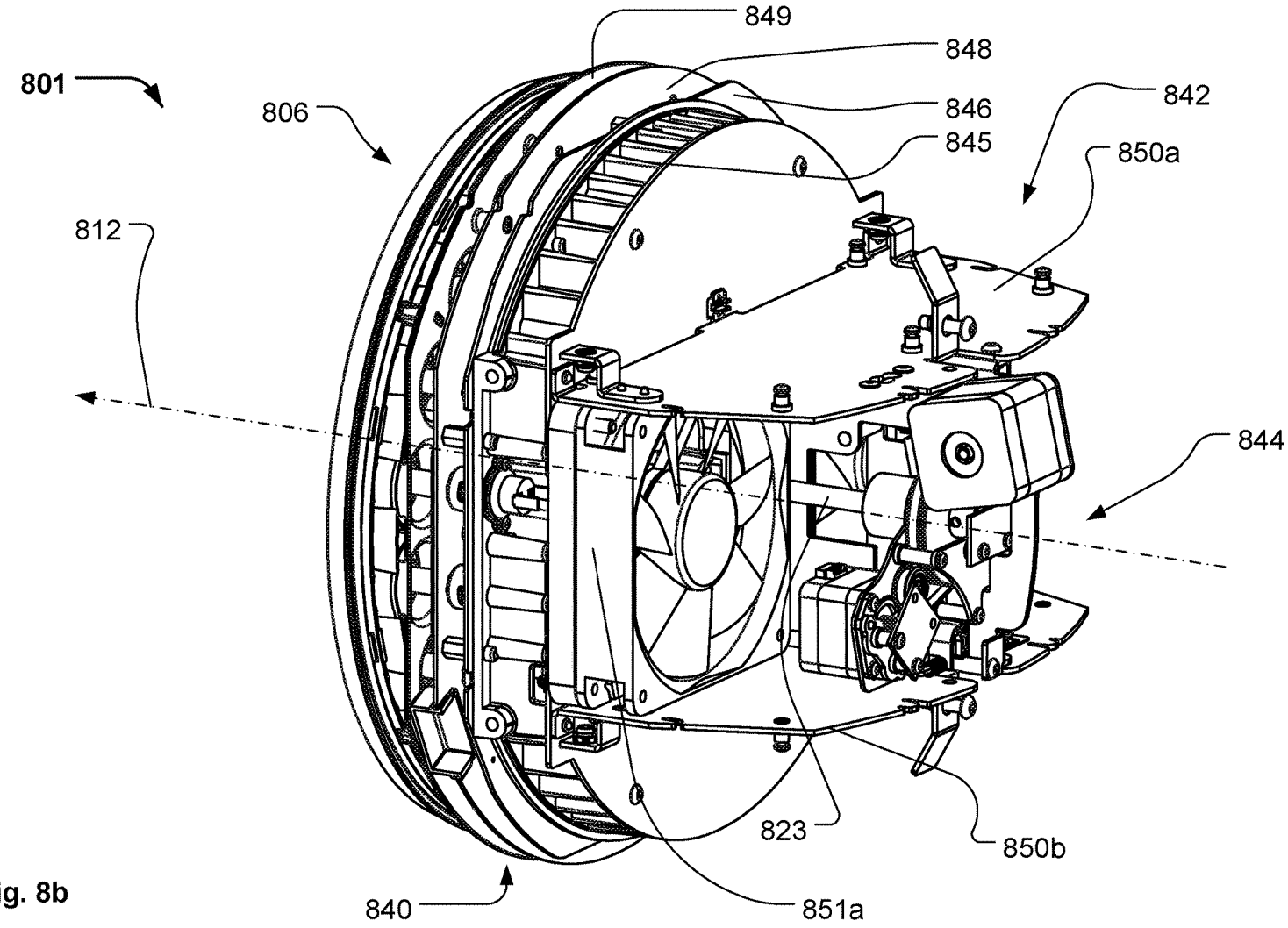
Figure 8C:
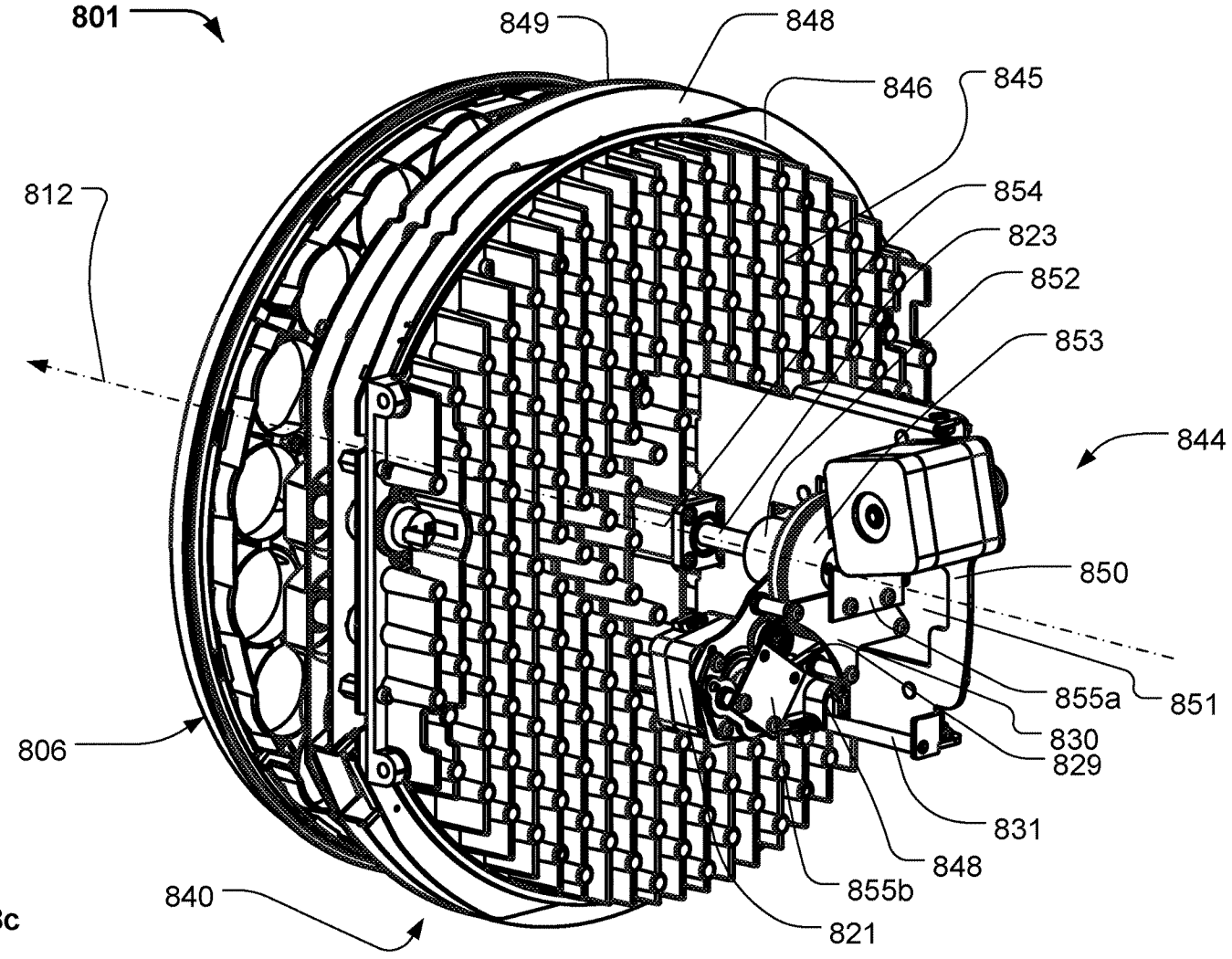
Figure 8D:
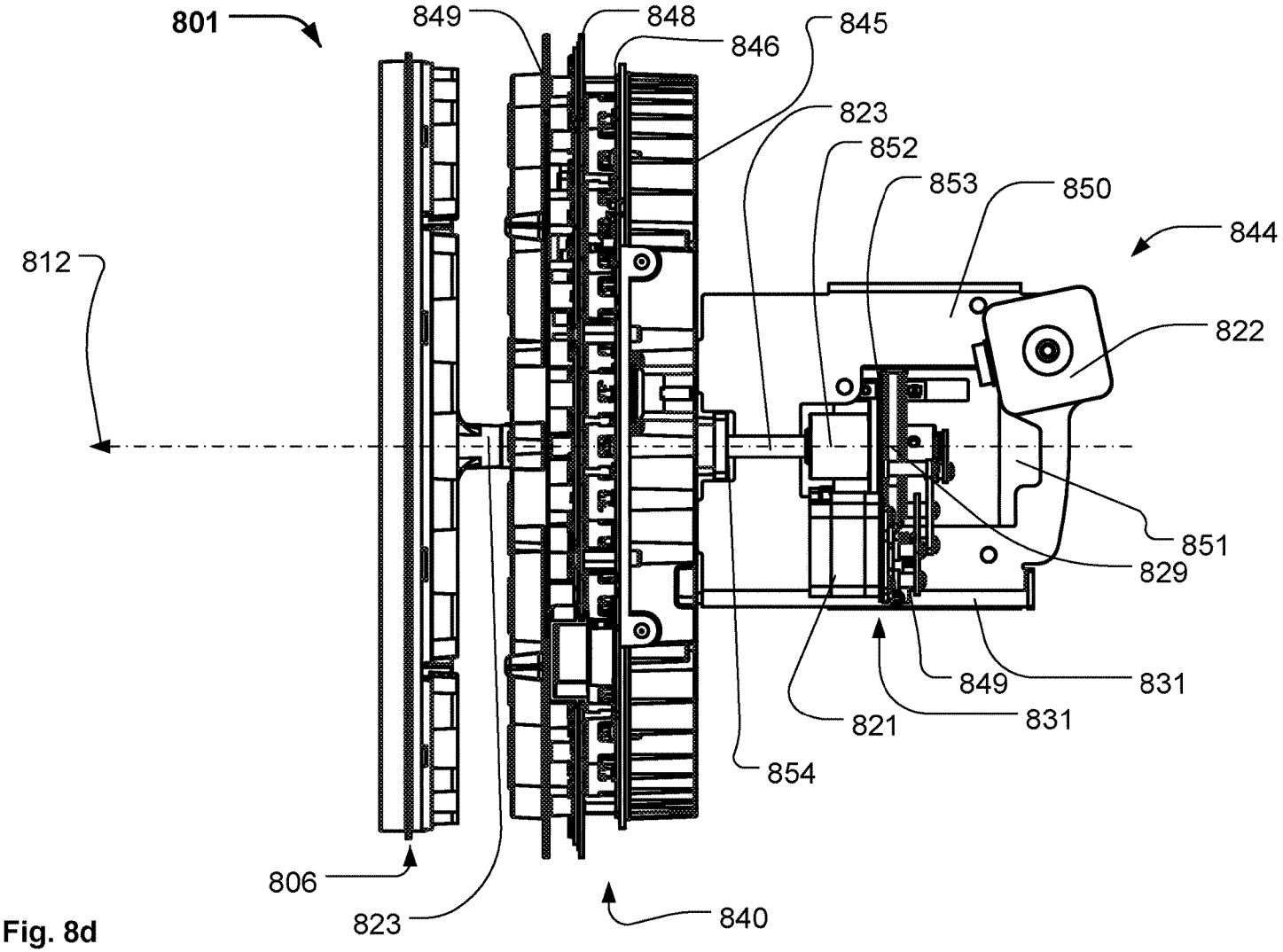

FIGS. 8*a*-8*d* illustrate another embodiment of an illumination device 801 according to the present invention; where FIG. 8*a* is a exploded view, FIG. 8*b* rear perspective view, FIG. 8*c* another rear perspective view with internal support structures removed, and FIG. 8*d* is a side view with internal support structures removed.

The illumination device 801 comprises zoom optics 806, a light source module 840, internal support structures 842 and a zoom/rotation module 844.

The light source module 840 comprises a heat sink 845, whereon a primary LED PCB 846 comprising a plurality of primary LEDs (not visible) are arranged. The plurality of LEDs is embodied as 4 in 1 LEDs each having a red emitter, a green emitter, a blue emitter and a white emitter. Light mixers 847 (only the exit surface of the light mixers visible in FIG. 8*a*) are arranged above each LED and are adapted to collect and mix light form the LED before it is emitted trough the exit surface of the light mixer. Further the light source module comprises a background LED PCB 847 comprising a number of background LEDs adapted to illuminate areas between the optical lenses of the zoom optics 806. A diffuser plate 849 is arranged above the background LED and diffuses the light from the background LED before illuminating the zoom optics. The diffuser plate 849 is embodied in a transparent diffusing material and comprises a number of apertures where through light beams form the light mixers passes without being diffused, as described in PCT/2011/050110 (WO 2011/131197) titled "LED LIGHT FIXTURE WITH BACKGROUND LIGHTING" filed 5th of Apr. 5, 2011.

The internal support structures (removed in FIGS. 8*c* and 8*d*) comprise two supports 850*a*, 850*b* which are secured to the heat sink 845. The supports 850*a*, 850*b* are adapted to support two cooling fans 851*a*, 851*b* and electronics 852 (not shown in FIG. 8*b*). Further the supports are adapted to secure the zoom/rotation module 844, which when mounted are fixed to the internal support structures. The shown components are arranged in a housing (not shown) and the housing can be embodied as a head of the moving head light fixture. The support structures, fans and electronics are removed in FIGS. 8*c* and 8*d* in order to show the zoom/rotation model 844.

The zoom optics comprises a front lens comprising plurality of optical lenses which are adapted to receive and refract light beams from the light mixers as described above. A central axle 823 is secured to the zoom optics and extends through the light source module, internal support structures and is connected to the zoom/rotation module.

Figure 9A:
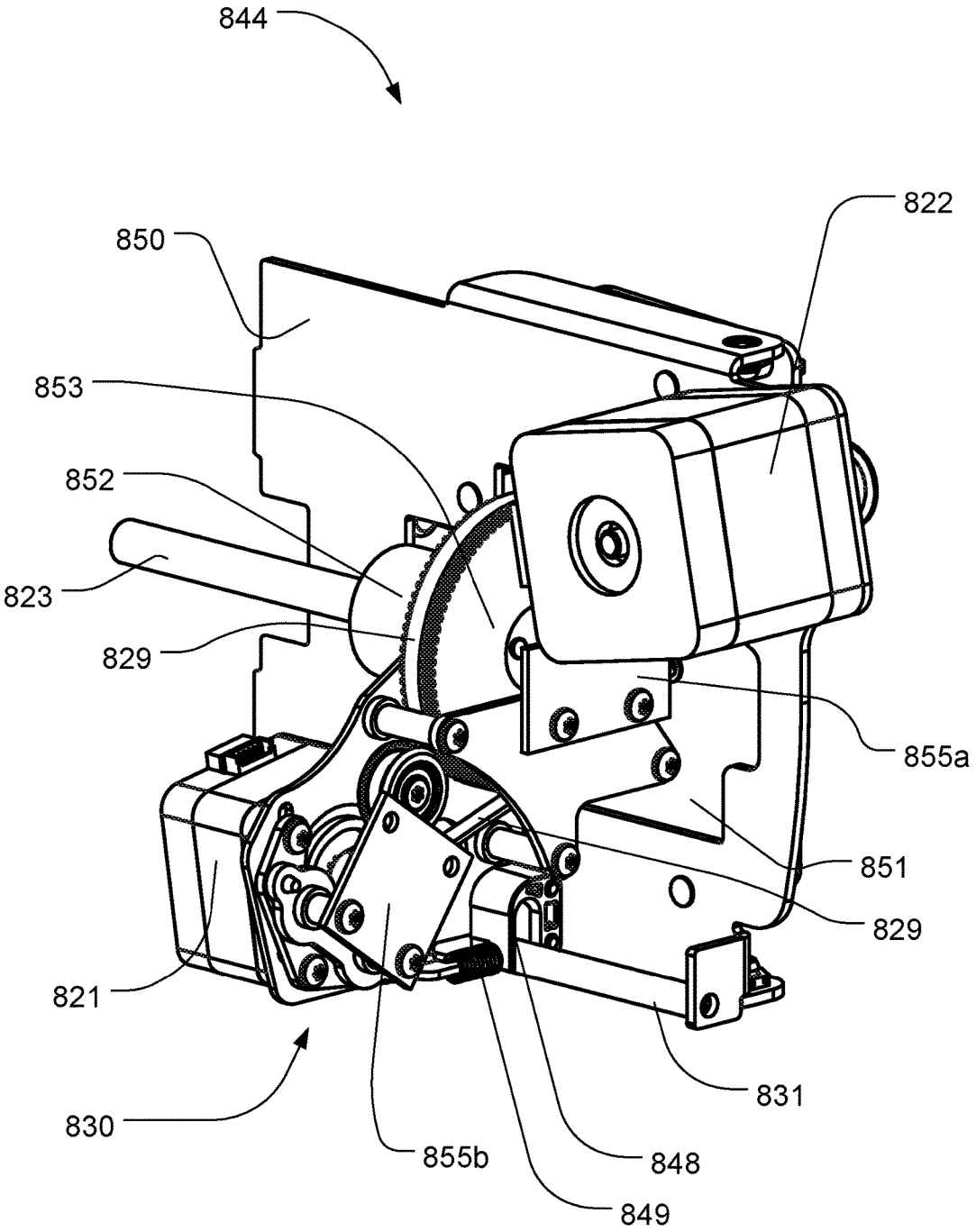
FIGS. 9*a*-9*c* illustrate a zoom and rotation means of the illumination device illustrated in FIGS. 8*a*-8*d*.
Figure 9B:
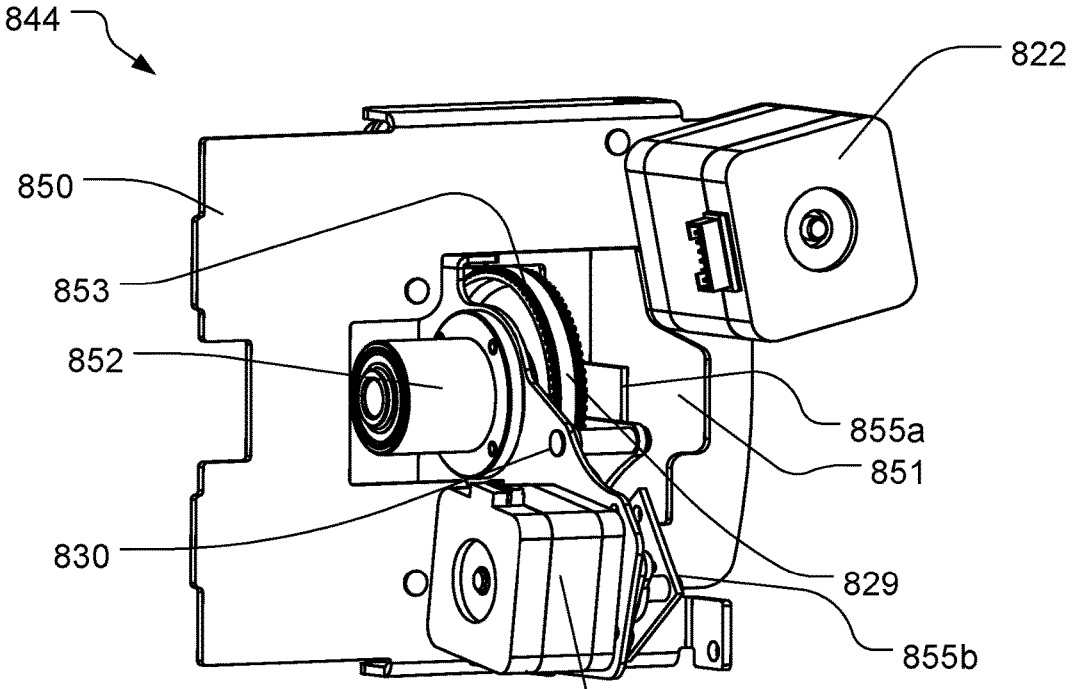
Figure 9C:
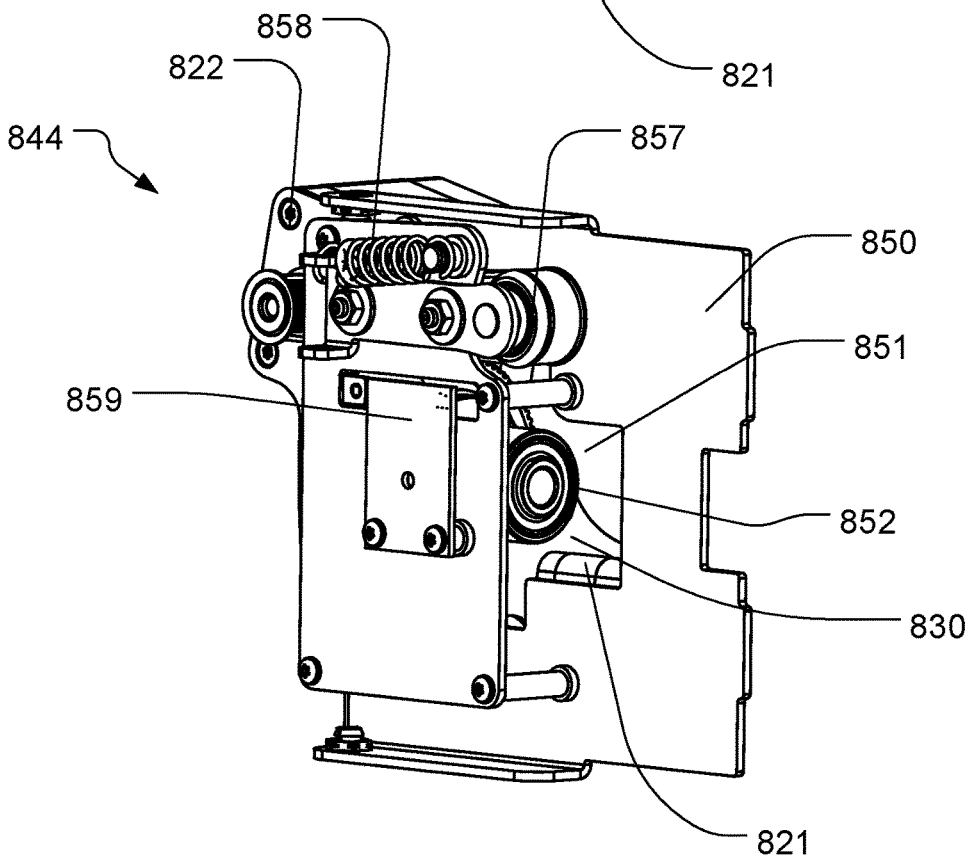

FIG. 9*a* illustrate a back perspective view of the zoom/rotation module 844; FIG. 9*b* illustrate a front perspective view (same side as in FIG. 9*a*) of the zoom/rotation module 844; and FIG. 9*c* illustrate a front perspective view (opposite side as in FIGS. 9*a* and 9*b*) of the zoom/rotation module 844.

Referring primarily to FIG. 8*b*-*d* and FIG. 9*a*-*b* the zoom/rotation module comprises a support plate 850 comprising an opening 851. A support track 831 (not shown in FIGS. 9*b* and 9*c*) arranged near the opening 851 and parallel with the optical axis 812 of the illumination device. A moving sled 830 is arranged in the opening and is movable attached to the support track 831 using a slidable clamp mechanism 848. The slidable clamp mechanism comprises two fingers adapted to grab around the support track, and at least one of the fingers is resilient, and spring means 849 are adapted to provide tension to the resilient finger whereby the clamp mechanism is clamped to the support track. The force of the spring means and size of the fingers are adapted to tighten the sled to the support track, but at the same time also to allow movement along the support track. The moving sled can thus be moved along the support track in a direction substantially parallel with the optical axis 812.

The central axle 823 (not shown in FIGS. 9*b* and 9*c*) of the zoom optics extends through the illumination module 840 and the support structures and is rotatable mounted at the moving sled 831. At the moving sled the central axle is supported by a sled support bearing 852 fixed to the moving sled and extends through the sled support bearing 852 and is connected to a toothed wheel 853 at the rear side of the sled support bearing 852. The moving sled 830 comprises a rotating actuator 821 that through a belt mechanism 829 is coupled to the toothed wheel 853. Rotating actuator 821 causes the central axle 823 to rotate whereby the zoom optics 806 rotates in relation to the optical axis 812 and the light sources.

The central axle 823 is supported by central support bearing 854 (not shown in FIGS. 9*a* and 9*b*) arranged at the heat sink, whereby the moving sled is balanced. The central axle support bearing is adapted to allow both rotation and movement along the optical axis. The moving sled comprises also a first 855*a* and second 855*b* magnetic encoder circuits. The magnetic encoder circuits are adapted to indicate to angular position of the zoom lens and can be implemented as the encoding system described in the patent application titled "MOVING HEAD LIGHT FIXTURE WITH YOKE AND HEAD POSITION ENCODING MEAN" filed 15 Mar. 2013 with application number PCT/DK2913/050069 and published as WO2013/139338 in cooperated herein by reference.

A zoom actuator 822 is arranged at the support plate and is adapted to drive a zoom belt 856 around a zoom pulley 857. The moving sled is coupled to the zoom belt 856 and activation of the zoom actuator causes the zoom belt to rotate around the zoom actuator axle and zoom pulley, whereby the moving sled 830 moves along the support track 831. As a consequence the central axle is moved along the optical axis 812 and courses the zoom optics to be moved along to optical axis. 812. A zoom belt tensioning spring 858 are also provided in order to provide correct tension the zoom belt. A magnetic zoom encoding circuit 859 also provided at the support plate and is adapted to indicate the zoom position of the moving sled.

It is noted that the illumination device illustrated in FIG. 8*a*-8*d* can be modified into an illumination device similar to the illumination device illustrated in FIG. 7*a*-7*b* by dividing the zoom optics 806 into an inner part and outer part where the inner part is moved and rotated by the zoom/rotation module like the one shown in FIG. 9*a*-9*c*. Further the outer module can be rotated by providing a number of the second rotate actuators as described in connection with FIG. 7*a*-*d*, where a peripheral rotate axle and the second actuator are arranged on a moving sled, which is movable along a support track by a second zoom actuator. The peripheral rotate axle, the second actuator and second zoom actuator can be embedded like the zoom/rotation system as described in FIG. 9*a*-*d*, with the difference that the peripheral rotate axle engages the outer perimeter of the second zoom optics.

The present invention does also relate to illumination device comprising:

a plurality of light sources generating light, said plurality of light sources are arranged in a first group of light sources and in a second group of light sources;

controlling means adapted to control said first group of light sources and said second group of light sources independently of each other;

a plurality of optical means, said plurality of optical means are arranged in a first group of optical means and in a second group of optical means, where said first group of optical means are adapted to receive light from said first group of light sources and adapted to convert the received light into a plurality of first source light beams, and where said second group of optical means are adapted to receive light from said second group of light sources and adapted to convert the received light into a plurality of second source light beams;

wherein said plurality of first source light beam and said plurality of second source light simultaneously propagates along a primary optical axis and wherein rotating means is adapted to rotate said optical means in relation to said light sources and wherein rotation of said plurality of optical means changes the angle of said plurality of light source beams in relation to said primary axis.

In one embodiment of the illumination device described above said second group of light sources are arranged in at least one concentric ring surrounding said first group of light sources and in that said second group of optical means are arranged in at least one concentric ring surrounding at least said first group of optical means.

In one embodiment of the illumination device described above the illumination device comprises further:

first light collecting means arranged between said first group of light sources and said first group of optical means, each of said first light collecting means being adapted to collect light generated by one of said light sources of said first group of light sources and adapted to convert said collected light into an first intermediate light source beam, where at least a part of said intermediate light source beams being received by one of said first optical means; and second light collecting means arranged between said second group of light sources and said second group of optical means, each of said second light collecting means being adapted to collect light generated by one of said light sources of said second group of light sources and adapted to convert said collected light into a second intermediate light source beam, where at least a part of said second intermediate light source beams being received by one of said second optical means.

In one embodiment of the illumination device described above at least two of said plurality of optical mans are separated by a separation area wherein said separation area comprises additional optical means adapted to receive and refract and at least one of said light source beam during rotation of said plurality of optical means in relation to said light sources.

In one embodiment of the illumination device described above said plurality of optical means in a first position in relation to said light sources are adapted to emit said light source beam substantial parallel with said primary optical axis and where said plurality of optical means in a second position in relation to said light sources are adapted to emit said light source beam at an angel in relation to said primary optical axis.

In one embodiment of the illumination device described above said plurality of optical means in said second position in relation to said light sources are adapted to emit said first light source beams at a first angel in relation to said primary optical axis and to emit said second light source beams at a second angel in relation to said primary optical axis and where said first angel and said second angel are different.

In one embodiment of the illumination device described above said rotating means comprises:

first rotating means adapted to rotate said first group of optical means;

second rotating means adapted to rotate said second group of optical means;

and wherein said controlling means are adapted to control said first rotating means and said second rotating means independently of each other.

In one embodiment of the illumination device described above, the illumination device comprises further zoom means adapted to move said plurality of optical means along to said optical axis and in relation to said light sources, and in that said controlling means being adapted to control said zoom means.

In one embodiment of the illumination device described above said plurality of optical means is adapted to image said light sources or the exit surface of said light collection means a distance along said primary optical axis.

In one embodiment of the illumination device described above said controlling means being adapted to control said zoom means and said rotating means independently of each other.

In one embodiment of the illumination device described above a third group of light sources are adapted to illuminate areas between said optical means when said optical mean are positioned in a first position and where said optical means in at least another position are adapted to receive light from at least one of said light sources of said third group of light sources.

The invention claimed is:

1. An illumination device, comprising:

a plurality of multi-die LEDs, where each of said multi-die LEDs comprises a plurality of LED dies emitting light of different colors;

a plurality of light mixers configured to receive light from said multi-die LEDs and to convert and mix the light into a plurality of source light beams, wherein said plurality of source light beams propagate along a primary optical axis;

a front lens comprising a plurality of optical front lenses, each of said optical front lenses is configured to receive one of said source light beams and to adjust at least one of the divergence and beam width of said source light beam;

a zoom actuator adapted to move said front lens along said primary optical axis relative to said multi-die LEDs and said light mixers;

a rotation actuator adapted to rotate said front lens around said primary optical axis relative to said multi-die LEDs and said light mixers;

wherein said rotation actuator is arranged on a moving sled, and said zoom actuator is connected to said moving sled, and wherein said zoom actuator is configured to move said moving sled along said primary optical axis, and wherein said moving sled is supported by at least one support track and is configured to move along said at least one support track.

2. An illumination device according to claim 1 wherein a controller is adapted to control said zoom actuator and said rotation actuator independently of each other.

3. An illumination device according to claim 2 wherein said controller is adapted to control said zoom actuator and said rotation actuator simultaneously.

4. An illumination device according claim 1 wherein a central zoom axle connects said moving sled and saki front lens, and said rotation actuator is adapted to rotate said central zoom axle around said primary optical axis.

5. An illumination device according to claim 4 wherein said central zoom axle is supported by a central support bearing and a sled support bearing, wherein said central support bearing is arranged at a support structure of said illumination device, and wherein saki sled support bearing is arranged at said moving sled.

6. An illumination device according to claim 1 wherein said plurality of optical front lenses are adapted to image said light sources or an exit surface of said light mixers at a distance along said primary optical axis.

7. An illumination device according to claim 1 wherein said plurality of multi-die LEDs, said plurality of light mixers, and said plurality of optical front lenses are arranged in a first group of multi-die LEDs, light mixers and optical front lenses and in a second group of multi-die LEDs, light mixers and optical front lenses, wherein said first group provides a first group of source light beams, and wherein said second group provides a second group of source light beams.

8. An illumination device according to claim 7 wherein said second group of multi-die LEDs, light mixers and optical front lenses are arranged in at least one concentric ring surrounding said first group of multi-die LEDs, light mixers and optical front lenses.

9. An illumination device according to claim 7 wherein said optical front lenses of said first group and said optical front lenses of said second group are provided as two separate parts, and wherein:

said zoom actuator is adapted to move said optical front lenses of said first group along said primary optical axis relative to said multi-die LEDs and said light mixers of said first group; and said rotate actuator is adapted to rotate said optical front lenses of said first group around said primary optical axis relative to said multi-die LEDs and said light mixers of said first group;

and wherein said illumination device further comprises:

a second rotation actuator adapted to rotate said optical front lenses of said second group around said primary optical axis relative to said multi-die LEDs and said light mixers of said second group.

10. An illumination device according to claim 9 wherein said second rotation actuator is arranged on said moving sled.

11. An illumination device according to claim 9 wherein said second rotation actuator is arranged on a second moving sled, and wherein a second zoom actuator is configured to move said second moving sled along said primary optical axis.

12. An illumination device according to claim 9 wherein said optical front lenses of said second group are provided on an annular ring surrounding said optical front lenses of said first group, and wherein said second rotation actuator is adapted to engage with a peripheral edge of said an annular ring.

13. An illumination device according to claim 7 wherein a controller is configured to control said multi-die LEDs of said first group and said multi-die LEDs of said second group individually.

14. A method of creating light effects, said method comprises the steps of:

creating a plurality of source light beams that propagate along a primary optical axis via a plurality of multi-die LEDs and a plurality of light mixers, wherein each of said multi-die LEDs comprises a plurality of LED dies emitting light of different colors, and wherein each of said light mixers is configured to receive light from one of said multi-die LEDs and to convert and mix the light into said plurality of source light beams;

adjusting at least one of the divergence and beam width of said plurality of source light beams by moving a front lens along said primary optical axis via a zoom actuator, wherein said front lens comprises a plurality of optical front lenses, each of said optical front lenses is configured to receive one of said source light beams and to adjust at least one of the divergence and beam width of said source light beam;

refracting said source light beams relative to said primary optical axis by rotating said front lens around said primary optical axis via a rotation actuator;

wherein moving said front lens along said primary optical axis via said zoom actuator comprises moving said rotation actuator along said primary optical axis by moving a moving sled along said primary optical axis, wherein said rotation actuator is arranged on said moving sled, and wherein said moving sled is supported by at least one support track and is configured to move along said at least one support track.

15. An illumination device, comprising:

a plurality of multi-die LEDs, where each of said multi-die LEDs comprises a plurality of LED dies emitting light of different colors;

a plurality of light mixers configured to receive light from said multi-die LEDs and to convert and mix the light into a plurality of source light beams, wherein said plurality of source light beams propagate along a primary optical axis;

a front lens comprising a plurality of optical front lenses, each of said optical front lenses is configured to receive one of said source light beams and to adjust at least one of the divergence and beam width of said source light beam;

a zoom actuator adapted to move said front lens along said primary optical axis relative to said multi-die LEDs and said light mixers;

a rotation actuator adapted to rotate said front lens around said primary optical axis relative to said multi-die LEDs and said light mixers;

wherein said rotation actuator is arranged on a moving sled, and said zoom actuator is connected to said moving sled, and wherein said zoom actuator is configured to move said moving sled along said primary optical axis, and wherein a central zoom axle connects said moving sled and said front lens, and wherein said central zoom axle is supported by a central support bearing and a sled support bearing, wherein said central support bearing is arranged at a support structure of said illumination device, and wherein said sled support bearing is arranged at said moving sled.

16. An illumination device according to claim 15, wherein said rotation actuator is adapted to rotate said central zoom axle around said primary optical axis.

* * * * *